US011268740B2

(12) United States Patent
Yamada et al.

(10) Patent No.: US 11,268,740 B2
(45) Date of Patent: Mar. 8, 2022

(54) REFRIGERATION APPARATUS

(71) Applicant: DAIKIN INDUSTRIES, LTD., Osaka (JP)

(72) Inventors: Takuro Yamada, Osaka (JP); Yuusuke Nakagawa, Osaka (JP); Yuusuke Oka, Osaka (JP); Masahiro Honda, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 142 days.

(21) Appl. No.: 16/338,257

(22) PCT Filed: Sep. 29, 2017

(86) PCT No.: PCT/JP2017/035632
§ 371 (c)(1),
(2) Date: Mar. 29, 2019

(87) PCT Pub. No.: WO2018/062528
PCT Pub. Date: Apr. 5, 2018

(65) Prior Publication Data

US 2019/0234660 A1 Aug. 1, 2019

(30) Foreign Application Priority Data

Sep. 30, 2016 (JP) ..... JP2016-192560
Nov. 1, 2016 (JP) ..... JP2016-214427

(51) Int. Cl.
*F25B 13/00* (2006.01)
*F25B 41/20* (2021.01)
*F25B 49/02* (2006.01)

(52) U.S. Cl.
CPC ..... *F25B 41/20* (2021.01); *F25B 13/00* (2013.01); *F25B 49/02* (2013.01);
(Continued)

(58) Field of Classification Search
CPC ... F25B 41/04; F25B 2313/0232; F25B 49/02
See application file for complete search history.

(56) References Cited

U.S. PATENT DOCUMENTS 5,076,068 A * 12/1991 Mikhail ..... F25B 41/04 62/196.4
5,263,333 A 11/1993 Kubo et al.
(Continued)

FOREIGN PATENT DOCUMENTS

DE 11 2012 005 151 T5 10/2014
EP 2910871 A1 * 8/2015 ..... F25B 43/02
(Continued)

OTHER PUBLICATIONS

Ikeda, Refrigeration device, 2012, Full Document (Year: 2012).*
(Continued)

*Primary Examiner* — Elizabeth J Martin
*Assistant Examiner* — Nael N Babaa
(74) *Attorney, Agent, or Firm* — Birch, Stewart, Kolasch & Birch, LLP

(57) ABSTRACT

An air conditioning system includes: outdoor and indoor heat exchangers; first, second, and third control valves, which block refrigerant flow when fully closed; and a pressure adjuster. The first and second control valves are disposed in a gas-side refrigerant flow path (GL) between the outdoor and indoor heat exchangers. The third control valve is disposed in a liquid-side refrigerant flow path (LL) between the outdoor and indoor heat exchangers. The pressure adjuster adjusts the pressure of refrigerant in an indoor-side refrigerant flow path (IL) between the first control valve and the second control valve or the third control valve and the indoor heat exchanger. The pressure adjuster includes a pressure adjusting valve that bypasses refrigerant in the indoor-side refrigerant flow path (IL) to an outdoor-side refrigerant flow path (OL) between the first control valve
(Continued)

and the second control valve or the third control valve and the outdoor heat exchanger.

19 Claims, 14 Drawing Sheets

(52) U.S. Cl.
CPC ..... *F25B 2313/0232* (2013.01); *F25B 2400/0403* (2013.01); *F25B 2400/0409* (2013.01); *F25B 2600/2501* (2013.01); *F25B 2600/2519* (2013.01)

(56) References Cited

U.S. PATENT DOCUMENTS

2010/0139312 A1* 6/2010 Takegami ..... F25B 13/00 62/498
2011/0030409 A1* 2/2011 Fujimoto ..... F25B 1/10 62/324.6
2011/0048041 A1 3/2011 Asprovski et al.
2011/0146339 A1* 6/2011 Yamashita ..... F24F 11/30 62/513
2014/0338382 A1 11/2014 Miyakoshi et al.
2015/0034293 A1* 2/2015 Takayama ..... F24F 11/83 165/207
2016/0273816 A1* 9/2016 Horiuchi ..... F25B 47/025

FOREIGN PATENT DOCUMENTS

JP H04-169755 A 6/1992
JP 2010-065992 A 3/2010
JP 2011-510254 A 3/2011
JP 5517789 B2 6/2014

OTHER PUBLICATIONS

Written Opinion of the International Searching Authority for International Application No. PCT/JP2017/035632, dated Nov. 11, 2017 with English translation.
International Search Report for PCT/JP2017/035632 (PCT/ISA/210) dated Nov. 28, 2017.
Extended European Search Report dated Sep. 19, 2019, for European Application No. 17856475.3.

* cited by examiner

REFRIGERATION APPARATUS

TECHNICAL FIELD

The present disclosure relates to a refrigeration apparatus.

BACKGROUND ART

PTL 1 (Japanese Patent No. 5517789) discloses an example of a refrigeration apparatus known in the art, which includes in a refrigerant circuit including a heat-source-side heat exchanger and a plurality of utilization-side heat exchangers, a switching valve, for switching flow of refrigerant, in each of a gas-side refrigerant flow path and a liquid-side refrigerant flow path disposed between the heat-source-side heat exchanger and each of the utilization-side heat exchangers. The refrigeration apparatus individually switches the direction of flow of refrigerant to each of the utilization-side heat exchangers by individually controlling the states of the switching valves.

SUMMARY OF THE INVENTION

Technical Problem

However, with the refrigeration apparatus described in PTL 1, which includes a shutoff valve in each of the gas-side refrigerant flow path and the liquid-side refrigerant flow path between the heat-source-side heat exchanger and each of the utilization-side heat exchangers, it may occur that the shutoff valves are simultaneously fully closed (flow of refrigerant is blocked). For example, in PTL 1, if refrigerant leakage is detected, the shutoff valves disposed in the gas-side refrigerant flow path and the liquid-side refrigerant flow path are controlled to be simultaneously fully closed. Moreover, for example, it may occur that the shutoff valves are simultaneously fully closed due to power supply failure, such as a blackout, malfunctioning of a switching valve, or the like.

In the refrigeration apparatus described above, when the shutoff valves disposed in the gas-side refrigerant flow path and the liquid-side refrigerant flow path are simultaneously fully closed, flow of refrigerant in refrigerant flow paths disposed between the utilization-side heat exchangers and the shutoff valves is blocked, and a liquid seal circuit may be formed. If the liquid seal circuit is formed, damage to a pipe or a device may occur in accordance with a change in the state of refrigerant in the liquid seal circuit and may lead to decrease in reliability.

The present disclosure provides a refrigeration apparatus that reduces decrease in reliability.

Solution to Problem

A refrigeration apparatus according to the present disclosure, which performs a refrigeration cycle in a refrigerant circuit, includes a heat-source-side heat exchanger, a utilization-side heat exchanger, a first shutoff valve, a second shutoff valve, and a pressure adjusting portion. The first shutoff valve is disposed in a gas-side refrigerant flow path. The gas-side refrigerant flow path is disposed between the heat-source-side heat exchanger and the utilization-side heat exchanger. The first shutoff valve blocks flow of refrigerant when fully closed. The second shutoff valve is disposed in a liquid-side refrigerant flow path. The liquid-side refrigerant flow path is disposed between the heat-source-side heat exchanger and the utilization-side heat exchanger. The second shutoff valve blocks flow of refrigerant when fully closed. The pressure adjusting portion adjusts a pressure of refrigerant in a utilization-side refrigerant flow path. The utilization-side refrigerant flow path is disposed between the first shutoff valve or the second shutoff valve and the utilization-side heat exchanger. The pressure adjusting portion includes a bypass mechanism. The bypass mechanism bypasses the refrigerant in the utilization-side refrigerant flow path to a heat-source-side refrigerant flow path. The heat-source-side refrigerant flow path is disposed between the first shutoff valve or the second shutoff valve and the heat-source-side heat exchanger.

This structure reduces blocking of flow of refrigerant in the utilization-side refrigerant flow path between the heat-source-side heat exchanger and the utilization-side heat exchanger and thereby reduces formation of a liquid seal circuit, even when the first shutoff valve and the second shutoff valve are simultaneously fully closed in a flow path switching unit. Thus, decrease in reliability is reduced.

In the refrigeration apparatus, preferably, the pressure adjusting portion further includes a bypass pipe. The bypass pipe forms a bypass flow path. The bypass flow path is a refrigerant flow path that extends from the utilization-side refrigerant flow path to the heat-source-side refrigerant flow path. The bypass mechanism is disposed in the bypass flow path. The bypass mechanism is a pressure adjusting valve that opens the bypass flow path when the pressure of the refrigerant in the utilization-side refrigerant flow path becomes higher than or equal to a predetermined reference value. In this case, it is possible to form the pressure adjusting portion with a simple structure. Thus, decrease in reliability is reduced while reducing increase in costs. Here, the term "predetermined reference value" refers to a value that may lead to damage to a pipe or a device of the utilization-side refrigerant flow path, and is appropriately selected in accordance with the specifications (capacity, type, and the like) and the arrangement of pipes and devices of the utilization-side refrigerant flow path.

In the refrigeration apparatus, preferably, the pressure adjusting valve is an expansion valve that includes a pressure sensing mechanism. The pressure sensing mechanism allows refrigerant to pass therethrough when receiving a pressure higher than or equal to the reference value. In this case, it is possible to form the pressure adjusting portion with a particularly simple structure. Thus, decrease in reliability is reduced while reducing increase in costs.

In the refrigeration apparatus, preferably, the bypass flow path extends from the utilization-side refrigerant flow path to the heat-source-side first refrigerant flow path. The heat-source-side first refrigerant flow path is a refrigerant flow path disposed between the first shutoff valve and the heat-source-side heat exchanger. In this case, even when the shutoff valves are simultaneously fully closed in the refrigeration apparatus, refrigerant in the utilization-side refrigerant flow path is bypassed to the heat-source-side first refrigerant flow path.

In the refrigeration apparatus, preferably, the bypass flow path extends to a heat-source-side second refrigerant flow path. The heat-source-side second refrigerant flow path is a refrigerant flow path disposed between the second shutoff valve and the heat-source-side heat exchanger. In this case, even when the shutoff valves are simultaneously fully closed in the refrigerant-flow-path switching unit, refrigerant in the utilization-side refrigerant flow path is bypassed to the heat-source-side second refrigerant flow path.

Preferably, the refrigeration apparatus further includes an electric expansion valve. The electric expansion valve is disposed in a refrigerant flow path between the utilization-side heat exchanger and the second shutoff valve. The electric expansion valve decompresses refrigerant that passes therethrough in accordance with an opening degree thereof. The electric expansion valve allows the refrigerant to pass therethrough even when the first shutoff valve and the second shutoff valve are fully closed. In this case, even when the shutoff valves are simultaneously fully closed, irrespective of the state of the electric expansion valve in the utilization unit, flow of refrigerant in the utilization-side refrigerant flow path is blocked, and formation of a liquid seal circuit is reduced. In particular, the distance between the second shutoff valve and the electric expansion valve in the utilization unit is generally small at installation sites. Moreover, during a normal operation, liquid refrigerant (including gas-liquid two-phase refrigerant) flows in a refrigerant flow path between the second shutoff valve and the electric expansion valve in the utilization unit. Therefore, a liquid seal circuit tends to be formed in the refrigerant flow path, if both of these valves are simultaneously fully closed. However, formation of a liquid seal circuit in such a manner is reduced. Thus, decrease in reliability is reduced.

Preferably, the refrigeration apparatus further includes a compressor and an accumulator. The compressor is disposed in a refrigerant flow path between the heat-source-side heat exchanger and the first shutoff valve. The compressor compresses refrigerant. The accumulator is disposed on a suction side of the compressor. The accumulator stores refrigerant. In this case, when the shutoff valves are simultaneously fully closed in the refrigeration apparatus, bypassed refrigerant is stored in the accumulator. Thus, occurrence of a liquid backflow phenomenon, in which liquid refrigerant is sucked into the compressor, is reduced.

Preferably, the refrigeration apparatus further includes a heat source unit, a plurality of utilization units, and a first shutoff valve unit. The heat-source-side heat exchanger is disposed in the heat source unit. The utilization-side heat exchanger is disposed in each of the utilization units. The first shutoff valve unit is disposed in the gas-side refrigerant flow path. The gas-side refrigerant flow path is disposed between the utilization units and the heat source unit. The first shutoff valve unit blocks flow of refrigerant in a corresponding one of the utilization units. The first shutoff valve is disposed in the first shutoff valve unit. The pressure adjusting portion is disposed in the first shutoff valve unit. In this case, in a circuit that is on the utilization side relative to the shutoff valve unit that is disposed in a refrigerant flow path disposed between the heat source unit and each of the utilization units, formation of a liquid seal circuit is reduced, and decrease in reliability is reduced.

Preferably, the refrigeration apparatus further includes a heat source unit, a plurality of utilization units, a first shutoff valve unit, and a second shutoff valve unit. The heat-source-side heat exchanger is disposed in the heat source unit. The utilization-side heat exchanger is disposed in each of the utilization units. The first shutoff valve unit is disposed in the gas-side refrigerant flow path. The gas-side refrigerant flow path is disposed between the utilization units and the heat source unit. The first shutoff valve unit blocks flow of refrigerant in corresponding one or more of the utilization units. The second shutoff valve unit disposed in the liquid-side refrigerant flow path. The liquid-side refrigerant flow path is disposed between the utilization units and the heat source unit. The second shutoff valve unit blocks flow of refrigerant in corresponding one or more of the utilization units. The first shutoff valve is disposed in the first shutoff valve unit. The second shutoff valve is disposed in the second shutoff valve unit. The pressure adjusting portion is disposed in the first shutoff valve unit or the second shutoff valve unit, or the pressure adjusting portion is disposed in each of the first shutoff valve unit and the second shutoff valve unit. In this case, in a circuit that is on the utilization side relative to the shutoff valve unit that is disposed in a refrigerant flow path disposed between the heat source unit and each of the utilization units, formation of a liquid seal circuit is reduced, and decrease in reliability is reduced.

Preferably, the refrigeration apparatus further includes a heat source unit, a plurality of utilization units, and a refrigerant-flow-path switching unit. The heat source unit is disposed in the heat-source-side heat exchanger. The utilization-side heat exchanger is disposed in each of the plurality of utilization units. The plurality of utilization units are arranged in parallel with the heat source unit. The refrigerant-flow-path switching unit is disposed in the gas-side refrigerant flow path and the liquid-side refrigerant flow path. The gas-side refrigerant flow path is disposed between a corresponding one of the utilization units and heat source unit. The liquid-side refrigerant flow path is disposed between a corresponding one of the utilization units and the heat source unit. The refrigerant-flow-path switching unit switches flow of refrigerant in the corresponding one of the utilization units. The first shutoff valve is disposed in the refrigerant-flow-path switching unit. The second shutoff valve is disposed in the refrigerant-flow-path switching unit. The pressure adjusting portion is disposed in the refrigerant-flow-path switching unit. In this case, in the refrigerant-flow-path switching unit that is disposed in a refrigerant flow path disposed between the heat source unit and each of the utilization units, formation of a liquid seal circuit is reduced, and decrease in reliability is reduced.

In the refrigeration apparatus, preferably, the gas-side refrigerant flow path includes a plurality of gas-side branch flow paths. Each of the gas-side branch flow paths branches off and is disposed between the heat source unit and a corresponding one of the utilization units. The gas-side branch flow path includes a first gas-side branch flow path and a second gas-side branch flow path. Low-pressure gas refrigerant flows in the first gas-side branch flow path. The second gas-side branch flow path branches off from the first gas-side branch flow path and extends to the heat source unit. Low-pressure/high-pressure gas refrigerant flows in the second gas-side branch flow path. The first shutoff valve is disposed in each of the first gas-side branch flow path and the second gas-side branch flow path of each of the gas-side branch flow paths. In this case, also when the refrigerant-flow-path switching unit is disposed in each of three refrigerant flow paths (the first gas-side branch flow path, the second gas-side branch flow path, and the liquid-side refrigerant flow path) that are disposed between the heat source unit and each of the utilization units, formation of a liquid seal circuit is reduced, and decrease in reliability is reduced.

In the refrigeration apparatus, preferably, the liquid-side refrigerant flow path includes a plurality of liquid-side branch flow paths. Each of the liquid-side branch flow paths branches off and is disposed between the heat source unit and a corresponding one of the utilization units. The liquid-side refrigerant flow path includes a plurality of liquid-side branching portions. The liquid-side branching portions are starting points of the liquid-side branch flow paths. The refrigerant-flow-path switching unit corresponds to a utilization unit group. The utilization unit group is constituted by a plurality of the utilization units. The second shutoff valve is disposed closer than each of the liquid-side branching portions to the heat-source-side heat exchanger. The bypass mechanism bypasses refrigerant in the utilization-side refrigerant flow path to the heat-source-side refrigerant flow path. The utilization-side refrigerant flow path is disposed between the second shutoff valve and each of the utilization-side heat exchangers. The heat-source-side refrigerant flow path is disposed between the first shutoff valve or the second shutoff valve and the heat-source-side heat exchanger. In this case, the number of second shutoff valves and pressure adjusting portions can be reduced, and increase in costs is reduced.

DESCRIPTION OF EMBODIMENTS

Hereinafter, an air conditioning system 100 according to an embodiment of the present disclosure (corresponding to "refrigeration apparatus") will be described with reference to the drawings. The embodiment described below is an example of the present disclosure, does not limit the technical scope, and may be appropriately modified within the spirit and scope of the present disclosure.

(1) Air Conditioning System 100

Figure 1:
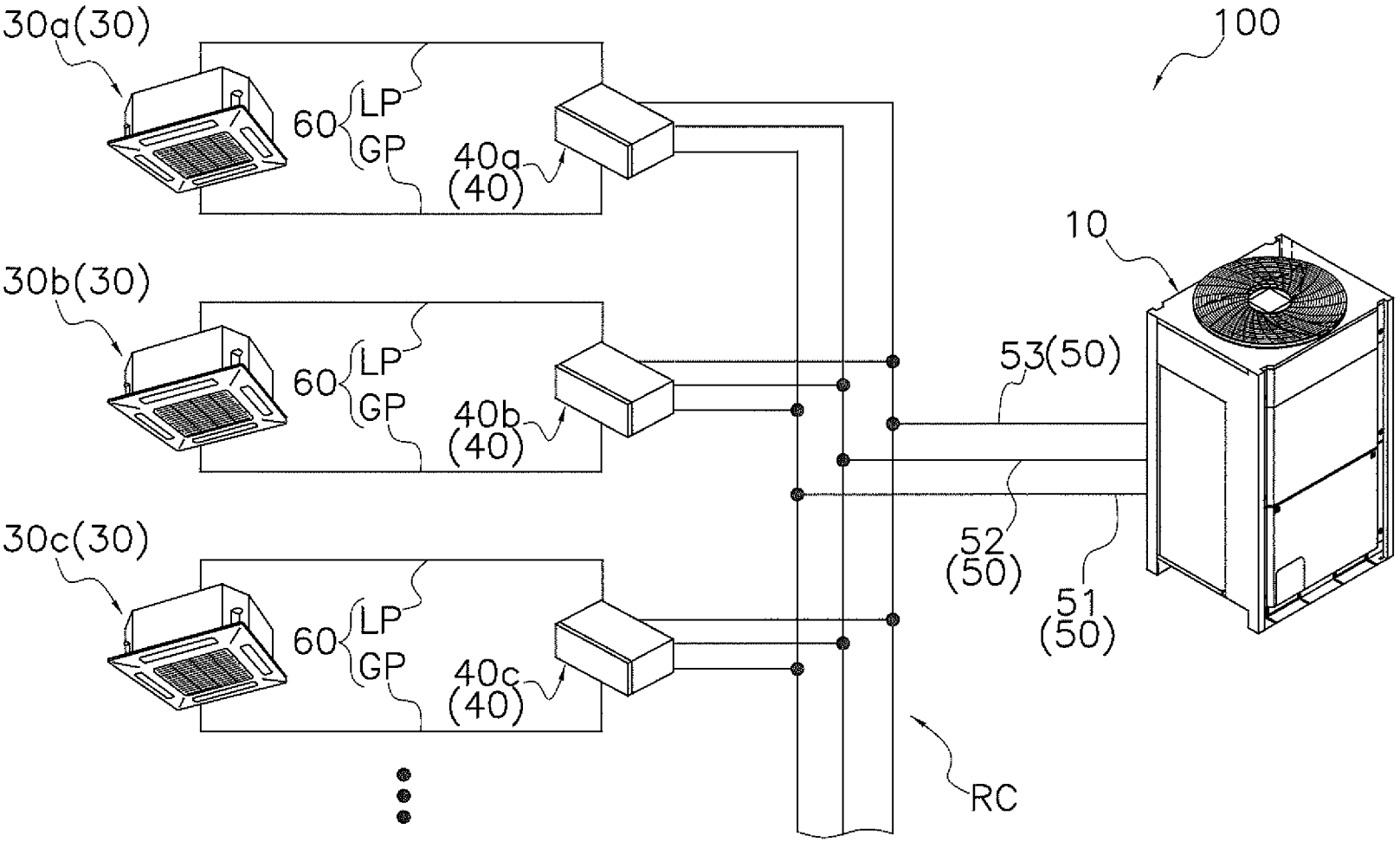
FIG. 1 is an overall view of an air conditioning system according to an embodiment of the present disclosure.

FIG. 1 is an overall view of the air conditioning system 100. The air conditioning system 100 is set in a building, a factory, or the like and performs air-conditioning of a target space. The air conditioning system 100, which is a refrigerant-pipe air conditioning system, cools and heats a target space by performing a refrigeration cycle in a refrigerant circuit RC.

The air conditioning system 100 mainly includes one outdoor unit 10, which is an example of a heat source unit; a plurality of indoor units 30 (30*a*, 30*b*, 30*c*, . . . ), which are examples of utilization units; a plurality of intermediate units 40 (40*a*, 40*b*, 40*c*, . . . ) that switch flow of refrigerant between the outdoor unit 10 and the indoor units 30; outdoor-side connection pipes 50 (a first connection pipe 51, a second connection pipe 52, and a third connection pipe 53) that extend between the outdoor unit 10 and the intermediate units 40; and a plurality of indoor-side connection pipes 60 (a liquid-side connection pipe LP and a gas-side connection pipe GP) that extend between each of the indoor units 30 and the intermediate units 40.

In the air conditioning system 100, each of the intermediate units 40 (corresponding to "refrigerant-flow-path switching unit") corresponds to one of the indoor units 30 and switches flow of refrigerant in the corresponding indoor unit 30. Thus, with the air conditioning system 100, operation modes, such as cooling operation and heating operation, of each of the indoor units 30 can be individually switched. That is, the air conditioning system 100 is a so-called "cooling/heating free type" system that allows a user to select cooling operation or heating operation of each of the indoor units 30. Each of the indoor units 30 receives a command related to switching between the operation modes and various settings, such as the setting temperature, from a user via a remote controller device (not shown).

In the following description, for convenience of description, an indoor unit 30 that is performing cooling operation will be referred to as "cooling indoor unit 30", an indoor unit 30 that is performing heating operation will be referred to as "heating indoor unit 30", and an indoor unit 30 whose operation is stopped or suspended will be referred to as "stopped indoor unit 30".

In the air conditioning system 100, a refrigerant circuit RC is formed because the outdoor unit 10 and the intermediate units 40 are individually connected by the outdoor-side connection pipes 50 and the intermediate units 40 and the corresponding indoor units 30 are connected by the indoor-side connection pipes 60. To be specific, the outdoor unit 10 and the intermediate units 40 are connected by the first connection pipe 51, the second connection pipe 52, and the third connection pipe 53, which are the outdoor-side connection pipes 50. Each of the indoor units 30 and a corresponding one of the intermediate units 40 are connected by the gas-side connection pipe GP and the liquid-side connection pipe LP, which are the indoor-side connection pipes 60. In other words, the refrigerant circuit RC includes one outdoor unit 10, a plurality of indoor units 30, and a plurality of intermediate units 40.

The air conditioning system 100 performs a vapor compression refrigeration cycle of compressing refrigerant that is sealed in the refrigerant circuit RC, cooling or condensing the refrigerant, decompressing the refrigerant, heating or evaporating the refrigerant, and then compressing the refrigerant again. Refrigerant used to fill the refrigerant circuit RC is not limited. For example, the refrigerant circuit RC is filled with R32 refrigerant.

The air conditioning system 100 performs gas-liquid two-phase transport of transporting refrigerant in a gas-liquid two-phase state in the third connection pipe 53 extending between the outdoor unit 10 and the intermediate unit 40. To be more specific, regarding refrigerant that is transported in the third connection pipe 53 extending between the outdoor unit 10 and the intermediate unit 40, it is possible to perform operation with a smaller amount of refrigerant while reducing capacity reduction in a case where the refrigerant is transported in a gas-liquid two-phase state than in a case where the refrigerant is transported in a liquid state. In consideration of this fact, the air conditioning system 100 performs gas-liquid two-phase transport in the third connection pipe 53 in order to save the amount of refrigerant used.

During operation, the operation state of the air conditioning system 100 is switched between a cooling only state, a heating only state, a cooling main state, a heating main state.

and a cooling/heating balanced state. A cooling only state is a state in which all the indoor units 30 are cooling indoor units 30 (that is, all the indoor units 30 in operation are performing cooling operation). A heating only operation is a state in which all the indoor units 30 are heating indoor units 30 (that is, all the indoor units 30 in operation are performing heating operation).

A cooling main state is a state in which it is assumed that thermal load of all the cooling indoor units 30 is larger than thermal load of all the heating indoor units 30. A heating main state is a state in which it is assumed that thermal load of all the heating indoor units 30 is larger than thermal load of all the cooling indoor units 30. The cooling/heating balanced state is a state in which it is assumed that thermal load of all the heating indoor units 30 and thermal load of all the cooling indoor units 30 balance out.

(1-1) Outdoor Unit 10 (Heat Source Unit)

Figure 2:
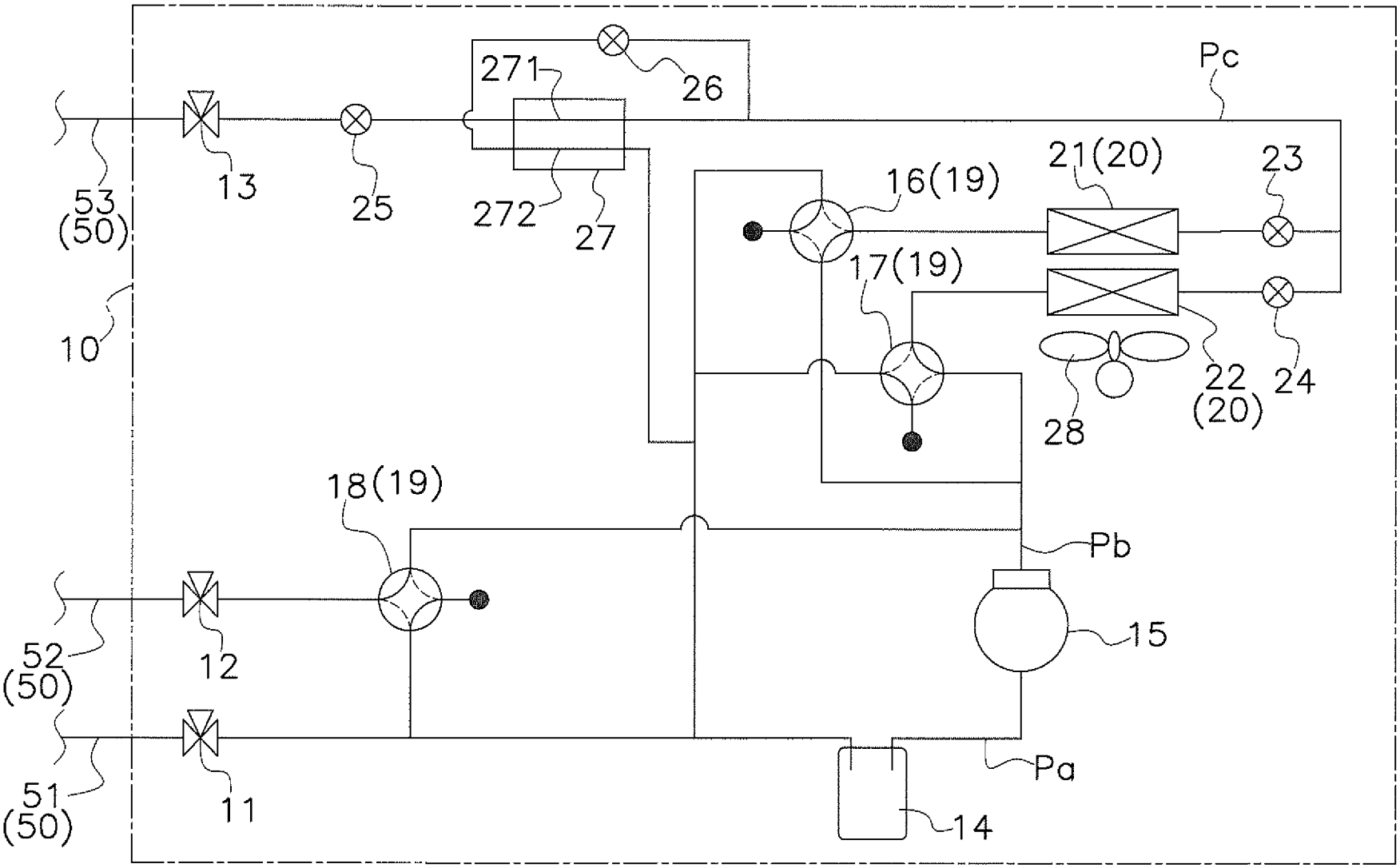
FIG. 2 illustrates a refrigerant circuit in an outdoor unit.

FIG. 2 illustrates a refrigerant circuit in the outdoor unit 10. The outdoor unit 10 is set outside a building, such as a roof or a balcony of a building, or in a space outside of a room, such as a basement (outside of a target space). The outdoor unit 10 mainly includes a gas-side first shutoff valve 11, a gas-side second shutoff valve 12, a liquid-side shutoff valve 13, an accumulator 14, a compressor 15, a first flow-path switching valve 16, a second flow-path switching valve 17, a third flow-path switching valve 18, an outdoor heat exchanger 20, a first outdoor control valve 23, a second outdoor control valve 24, a third outdoor control valve 25, a fourth outdoor control valve 26, and a subcooling heat exchanger 27. In the outdoor unit 10, these devices are disposed in a casing and connected to each other via refrigerant pipes, thereby constituting a part of the refrigerant circuit RC. The outdoor unit 10 further includes an outdoor fan 28 and an outdoor unit controller (not shown).

The gas-side first shutoff valve 11, the gas-side second shutoff valve 12, and the liquid-side shutoff valve 13 are manual valves that are opened or closed when filling pipes with refrigerant or when performing pump down.

One end of the gas-side first shutoff valve 11 is connected to the first connection pipe 51, and the other end of the gas-side first shutoff valve 11 is connected to a refrigerant pipe extending to the accumulator 14. One end of the gas-side second shutoff valve 12 is connected to the second connection pipe 52, and the other end of the gas-side second shutoff valve 12 is connected to a refrigerant pipe extending to the third flow-path switching valve 18. The gas-side first shutoff valve 11 and the gas-side second shutoff valve 12 each function as a port through which gas refrigerant flows into or out of in the outdoor unit 10 (gas-side port).

One end of the liquid-side shutoff valve 13 is connected to the third connection pipe 53, and the other end of the liquid-side shutoff valve 13 is connected to a refrigerant pipe extending to the third outdoor control valve 25. The liquid-side shutoff valve 13 functions as a port through which liquid refrigerant or gas-liquid two-phase refrigerant flows into or out of the outdoor unit 10 (liquid-side port).

The accumulator 14 is a container for temporarily storing low-pressure refrigerant to be sucked into the compressor 15 and performs gas-liquid separation of the refrigerant. In the accumulator 14, refrigerant in a gas-liquid two-phase state is separated into gas refrigerant and liquid refrigerant. The accumulator 14 is disposed between the gas-side first shutoff valve 11 and the compressor 15 (that is, on the suction side of the compressor 15). A refrigerant pipe extending from the gas-side first shutoff valve 11 is connected to a refrigerant port of the accumulator 14. A suction pipe Pa extending to the compressor 15 is connected to a refrigerant outlet of the accumulator 14.

The compressor 15 has a hermetic structure in which a compressor motor (not shown) is disposed. For example, the compressor 15 is a positive-displacement compressor including a compression mechanism of a scroll type, a rotary type, or the like. The present embodiment has only one compressor 15. However, the number of the compressor 15 is not limited to one, and two or more compressors 15 may be connected in series or in parallel. The suction pipe Pa is connected to a suction port (not shown) of the compressor 15. A discharge pipe Pb is connected to a discharge port (not shown) of the compressor 15. The compressor 15 compresses low-pressure refrigerant that is sucked thereinto via the suction pipe Pa, and discharges the refrigerant to the discharge pipe Pb.

The suction side of the compressor 15 communicates with each of the intermediate units 40 via the suction pipe Pa, the accumulator 14, the gas-side first shutoff valve 11, the first connection pipe 51, and the like. The suction side or the discharge side of the compressor 15 communicates with each of the intermediate units 40 via the suction pipe Pa, the accumulator 14, the gas-side second shutoff valve 12, the second connection pipe 52, and the like. The discharge side or the suction side of the compressor 15 communicates with the outdoor heat exchanger 20 via the discharge pipe Pb, the first flow-path switching valve 16, the second flow-path switching valve 17, and the like. That is, the compressor 15 is disposed between each of the intermediate units 40 (a first control valve 41 and a second control valve 42) and the outdoor heat exchanger 20.

The first flow-path switching valve 16, the second flow-path switching valve 17, and the third flow-path switching valve 18 (hereinafter, collectively referred to as "flow-path switching valve 19") are each a four-way switching valve and switch flow of refrigerant in accordance with conditions (see the solid lines and broken lines in the flow-path switching valve 19 in FIG. 2). A branch pipe extending from the discharge pipe Pb or the discharge pipe Pb is connected to a refrigerant port of the flow-path switching valve 19. The flow-path switching valve 19 is configured in such a way that flow of refrigerant in one refrigerant flow path is blocked during operation, thereby practically functioning as a three-way valve. The flow-path switching valve 19 can be switched between a first flow path state (see the solid lines in the flow-path switching valve 19 in FIG. 2) in which the flow-path switching valve 19 feeds refrigerant, which is fed from the discharge side of the compressor 15 (the discharge pipe Pb), toward the downstream side; and a second flow path state (see the broken lines in the flow-path switching valve 19 in FIG. 2) in which the flow-path switching valve 19 blocks flow of the refrigerant.

The first flow-path switching valve 16 is disposed on the refrigerant inlet-side/outlet-side of a first outdoor heat exchanger 21 (described below) of the outdoor heat exchanger 20. In the first flow path state, the first flow-path switching valve 16 allows the discharge side of the compressor 15 and the gas-side port of the first outdoor heat exchanger 21 to communicate with each other (see the solid lines in the first flow-path switching valve 16 in FIG. 2). In the second flow path state, the first flow-path switching valve 16 allows the suction side of the compressor 15 (the accumulator 14) and the gas-side port of the first outdoor heat exchanger 21 to communicate with each other (see the broken lines in the first flow-path switching valve 16 in FIG. 2).

The second flow-path switching valve 17 is disposed on the refrigerant inlet-side/outlet-side of a second outdoor heat exchanger 22 (described below) of the outdoor heat exchanger 20. In the first flow path state, the second flow-path switching valve 17 allows the discharge side of the compressor 15 and the gas-side port of the second outdoor heat exchanger 22 to communicate with each other (see the solid lines in the second flow-path switching valve 17 in FIG. 2). In the second flow path state, the second flow-path switching valve 17 allows the suction side of the compressor 15 (the accumulator 14) and the gas-side port of the second outdoor heat exchanger 22 to communicate with each other (see the broken lines in the second flow-path switching valve 17 in FIG. 2).

In the first flow path state, the third flow-path switching valve 18 allows the discharge side of the compressor 15 and the gas-side second shutoff valve 12 to communicate with each other (see the solid lines in the third flow-path switching valve 18 in FIG. 2). In the second flow path state, the third flow-path switching valve 18 allows the suction side of the compressor 15 (the accumulator 14) and the gas-side second shutoff valve 12 to communicate with each other (see the broken lines in the third flow-path switching valve 18 in FIG. 2).

The outdoor heat exchanger 20 is a heat exchanger of a cross-fin type, a stacked type, or the like, and includes a heat transfer tube (not shown) through which refrigerant passes. The outdoor heat exchanger 20 functions as a condenser and/or an evaporator for refrigerant in accordance with flow of refrigerant. To be more specific, the outdoor heat exchanger 20 includes the first outdoor heat exchanger 21 and the second outdoor heat exchanger 22.

A refrigerant pipe connected to the first flow-path switching valve 16 is connected to a gas-side refrigerant port of the first outdoor heat exchanger 21, and a refrigerant pipe extending to the first outdoor control valve 23 is connected to a liquid-side refrigerant port of the first outdoor heat exchanger 21. A refrigerant pipe connected to the second flow-path switching valve 17 is connected to a gas-side refrigerant port of the second outdoor heat exchanger 22, and a refrigerant pipe extending to the second outdoor control valve 24 is connected to a liquid-side refrigerant port of the second outdoor heat exchanger 22. Refrigerant that passes through the first outdoor heat exchanger 21 and the second outdoor heat exchanger 22 exchanges heat with air flow generated by the outdoor fan 28.

The first outdoor control valve 23, the second outdoor control valve 24, the third outdoor control valve 25, and the fourth outdoor control valve 26 are, for example, electric valves whose opening degrees are adjustable. The first outdoor control valve 23, the second outdoor control valve 24, the third outdoor control valve 25, and the fourth outdoor control valve 26, whose opening degrees are adjusted in accordance with conditions, each decompress refrigerant passing therethrough or increases/decreases the flow rate of refrigerant passing therethrough in accordance with the opening degrees thereof.

A refrigerant pipe extending from the first outdoor heat exchanger 21 is connected to one end of the first outdoor control valve 23, and a liquid-side pipe Pc extending to one end of a first flow path 271 (described below) of the subcooling heat exchanger 27 is connected to the other end of the first outdoor control valve 23. A refrigerant pipe extending from the second outdoor heat exchanger 22 is connected to one end of the second outdoor control valve 24, and the liquid-side pipe Pc extending to the one end of the first flow path 271 of the subcooling heat exchanger 27 is connected to the other end of the second outdoor control valve 24. One end of the liquid-side pipe Pc bifurcates into two portions that are individually connected to the first outdoor control valve 23 and the second outdoor control valve 24.

A refrigerant pipe extending to the other end the first flow path 271 of the subcooling heat exchanger 27 is connected to one end of the third outdoor control valve 25 (decompression valve), and the other end the third outdoor control valve 25 is connected to a refrigerant pipe extending to the liquid-side shutoff valve 13. That is, the third outdoor control valve 25 is disposed between the outdoor heat exchanger 20 and the third connection pipe 53. As described below, when the operation state of the air conditioning system 100 is one of the cooling only state, the cooling main state, or the cooling-heating balanced state, the third outdoor control valve 25 is controlled to a two-phase-transport opening degree so as to perform gas-liquid two-phase transport in the third connection pipe 53. The two-phase-transport opening degree is an opening degree with which the third outdoor control valve 25 decompresses refrigerant to a pressure that is supposed to be suitable for transporting refrigerant in a gas-liquid two-phase state in the third connection pipe 53. That is, the two-phase-transport opening degree is an opening degree that is suitable for gas-liquid two-phase transport in the third connection pipe 53.

A branch pipe that branches off from a position between both ends of the liquid-side pipe Pc is connected to one end of the fourth outdoor control valve 26, and a refrigerant pipe extending to one end of a second flow path 272 (described below) of the subcooling heat exchanger 27 is connected to the other end of the fourth outdoor control valve 26.

The subcooling heat exchanger 27 is a heat exchanger for changing refrigerant flowed out of the outdoor heat exchanger 20 into liquid refrigerant in a subcooled state. The subcooling heat exchanger 27 is, for example, a double-pipe heat exchanger. The subcooling heat exchanger 27 has the first flow path 271 and the second flow path 272. To be more specific, the subcooling heat exchanger 27 has a structure that allows refrigerant flowing through the first flow path 271 and refrigerant flowing through the second flow path 272 to exchange heat. One end of the first flow path 271 is connected to the other end of the liquid-side pipe Pc, and other end of the first flow path 271 is connected to a refrigerant pipe extending to the third outdoor control valve 25. One end of the second flow path 272 is connected to a refrigerant pipe extending to the fourth outdoor control valve 26, and the other end of the second flow path 272 is connected to a refrigerant pipe extending to the accumulator 14 (to be more specific, a refrigerant pipe extending between the accumulator 14 and the first flow-path switching valve 16 or the gas-side first shutoff valve 11).

The outdoor fan 28 is, for example, a propeller fan, and includes an outdoor fan motor (not shown) that is a driving source. When the outdoor fan 28 is driven, air flow is generated in such a way that air flows into the outdoor unit 10, passes through the outdoor heat exchanger 20, and flows out of the outdoor unit 10.

The outdoor unit controller includes a microcomputer that is composed of a CPU, a memory, and the like. The outdoor unit controller transmits signals to and receives signals from an indoor unit controller (described below) and an intermediate unit controller (described below) via communication lines (not shown). The outdoor unit controller controls the operations and states of various devices included in the outdoor unit 10 (for example, starting/stopping of and the rotation speed of the compressor 15 and the outdoor fan 28, or switching of the opening degrees of various valves) in accordance with conditions.

Although not illustrated in FIG. 2, various sensors for detecting the states (the pressure or the temperature) of refrigerant in the refrigerant circuit RC are disposed in the outdoor unit 10.

(1-2) Indoor Unit 30 (Utilization Unit)

Figure 3:
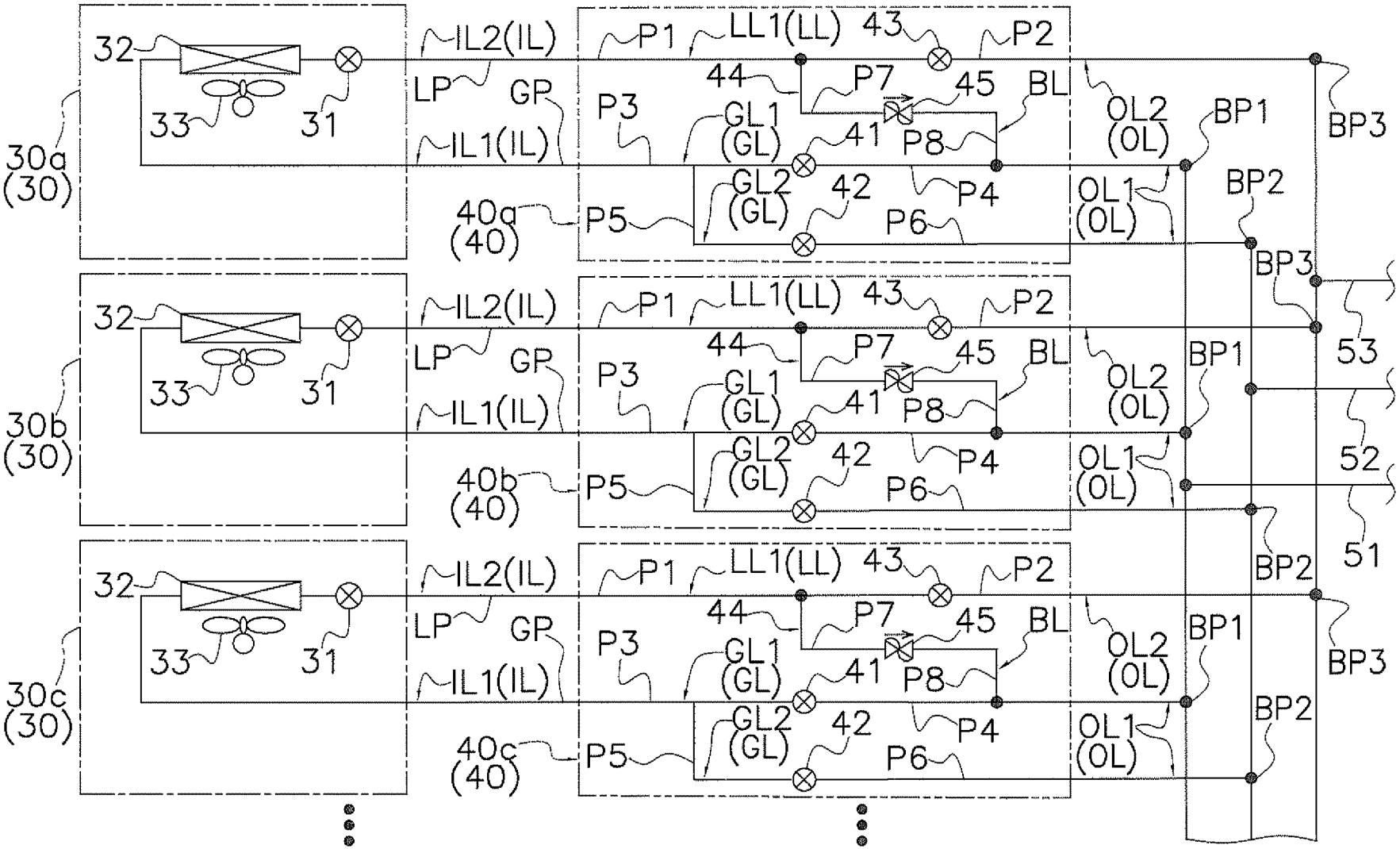
FIG. 3 illustrates a refrigerant circuit in indoor units and intermediate units.

FIG. 3 illustrates a refrigerant circuit in the indoor units 30 and the intermediate units 40. The type of the indoor units 30 is not limited. For example, the indoor units 30 are each a ceiling-mounted unit that is set in a ceiling space. The air conditioning system 100 includes a plurality of (n pieces) indoor units 30 (30*a*, 30*b*, 30*c*, . . . ) that are arranged in parallel with the outdoor unit 10.

Each of the indoor units 30 includes an indoor expansion valve 31 and an indoor heat exchanger 32. In each of the indoor units 30, these devices of are disposed in a casing and are connected to each other by refrigerant pipes, thereby constituting a part of the refrigerant circuit RC. Each of the indoor units 30 includes an indoor fan 33 and an indoor unit controller (not shown).

The indoor expansion valve 31 (corresponding to "electric expansion valve" in the claims) is an electric expansion valve whose opening degree is adjustable. One end of the indoor expansion valve 31 is connected to the liquid-side connection pipe LP, and the other end of the indoor expansion valve 31 is connected to a refrigerant pipe extending to the indoor heat exchanger 32. That is, the indoor expansion valve 31 is disposed between the indoor heat exchanger 32 and the third connection pipe 53. In other words, the indoor expansion valve 31 is disposed in a refrigerant flow path between the indoor heat exchanger 32 and a third control valve 43 in the intermediate unit 40. The indoor expansion valve 31 decompresses refrigerant passing therethrough in accordance with the opening degree thereof. In the present embodiment, when the indoor expansion valve 31 is in a closed state (minimum opening degree), the indoor expansion valve 31 is slightly open and forms a very small flow path that allows a very small amount of refrigerant to pass therethrough. Therefore, the indoor expansion valve 31 allows refrigerant to pass therethrough even when the first control valve 41, the second control valve 42, and the third control valve 43 of the intermediate unit 40 (described below) are fully closed in the refrigerant circuit RC.

The indoor heat exchanger 32 (corresponding to "utilization-side heat exchanger" in the claims) is, for example, a heat exchanger of a cross-fin type or a stacked type and includes a heat transfer tube (not shown) through which refrigerant passes. The indoor heat exchanger 32 functions as an evaporator or a condenser for refrigerant in accordance with flow of refrigerant. A refrigerant pipe extending from the indoor expansion valve 31 is connected to a liquid-side refrigerant port of the indoor heat exchanger 32, and the gas-side connection pipe GP is connected a gas-side refrigerant port of the indoor heat exchanger 32. When refrigerant flowed into the indoor heat exchanger 32 passes through the heat transfer tube, the refrigerant exchanges heat with air flow that is generated by the indoor fan 33.

In accordance with the state (open/closed state) of control valves (41, 42, 43) in a corresponding one of the intermediate units 40 and the state (flow path state) of the flow-path switching valve 19 (16, 17, 18) in the outdoor unit 10, the upstream side and the downstream side of flow of refrigerant into the indoor heat exchanger 32 is switched, and the indoor heat exchanger 32 is switched between a state in which the indoor heat exchanger 32 functions as an evaporator for refrigerant and a state in which the indoor heat exchanger 32 functions as a condenser for refrigerant.

The indoor fan 33 is, for example, a centrifugal fan such as a turbo fan. The indoor fan 33 includes an indoor fan motor (not shown) that is a drive source. When the indoor fan 33 is driven, air flow is generated in such a way that air flows from a target space into the indoor units 30, passes through the indoor heat exchanger 32, and then flows out to the target space.

The indoor unit controller includes a microcomputer that is composed of a CPU, a memory, and the like. The indoor unit controller receives a command from a user via a remote controller (not shown). In accordance with the command, the indoor unit controller controls the operations and states of various devices included in the indoor unit 30 (such as the rotation speed of the indoor fan 33 and the opening degree of the indoor expansion valve 31). The indoor unit controller is connected to the outdoor unit controller and the intermediate unit controller (described below) via communication lines (not shown) and send signals to and receive signals from each other. The indoor unit controller includes a communication module that performs wired communication or wireless communication with a remote controller and sends signals to and receives signals from the remote controller.

Although not illustrated, the indoor unit 30 includes various sensors, such as a temperature sensor for detecting superheating/subcooling degree of refrigerant passing through the indoor heat exchanger 32, and a temperature sensor for detecting the temperature (indoor temperature) of air in a target space sucked by the indoor fan 33.

(1-3) Intermediate Unit 40 (Refrigerant-Flow-Path Switching Unit)

The air conditioning system 100 includes a plurality of intermediate units 40 (40*a*, 40*b*, 40*c*, . . . ) (here, the number of the intermediate units 40 is the same as that of the indoor units 30). In the present embodiment, the intermediate units 40 correspond one-to-one to the indoor units 30. Each of the intermediate units 40 is disposed in a gas-side refrigerant flow path GL (described below) and a liquid-side refrigerant flow path LL (described below) between a corresponding one of the indoor units 30 (hereinafter, referred to as "corresponding indoor unit 30") and the outdoor unit 10 and switches flow of refrigerant into the corresponding indoor unit.

As illustrated in FIG. 3, each of the intermediate units 40 includes a plurality of refrigerant pipes (first to eight pipes P1 to P8), a plurality of control valves (the first control valve 41, the second control valve 42, and the third control valve 43), and a pressure adjusting portion 44. In the intermediate unit 40, these devices are disposed in a casing and connected to each other via refrigerant pipes, thereby constituting a part of the refrigerant circuit RC.

One end of the first pipe P1 is connected to the liquid-side connection pipe LP, and the other end of the first pipe P1 is connected to the third control valve 43. One end of the second pipe P2 is connected to the third control valve 43, and the other end of the second pipe P2 is connected to the third connection pipe 53. One end of the third pipe P3 is connected to the gas-side connection pipe GP, and the other end of the third pipe P3 is connected to the first control valve 41. One end of the fourth pipe P4 is connected to the first control valve 41, and the other end of the fourth pipe P4 is connected to the first connection pipe 51. One end of the fifth pipe P5 is connected to a part of the third pipe P3 between both ends of the third pipe P3, and the other end of the fifth pipe P5 is connected to the second control valve 42. One end of the sixth pipe P6 is connected to the second control valve 42, and the other end of the sixth pipe P6 is connected to the second connection pipe 52.

One end of the seventh pipe P7 is connected to a part of the first pipe P1 between both ends of the first pipe P1, and the other end of the seventh pipe P7 is connected to a pressure adjusting valve 45. One end the eighth pipe P8 is connected to the pressure adjusting valve 45, and other end of the eighth pipe P8 is connected to a part of the fourth pipe P4 between both ends of the fourth pipe P4. The seventh pipe P7 and the eighth pipe P8 each correspond to "bypass pipe" of the pressure adjusting portion 44 that forms a bypass flow path BL described below.

Each of the refrigerant pipes (P1 to P8) disposed in the intermediate unit 40 need not be a single pipe, and may be composed of a plurality of pipes that are connected via joints or the like.

The first control valve 41, the second control valve 42, and the third control valve 43 switch flow of refrigerant in the corresponding indoor unit 30 by switching between opening and closing of a refrigerant flow path formed between the outdoor unit 10 and the corresponding indoor unit 30. The first control valve 41, the second control valve 42, and the third control valve 43 are electric valves whose opening degrees are adjustable, and switch flow of refrigerant by allowing passage of refrigerant or blocking refrigerant in accordance with the opening degrees thereof. In a closed state (minimum opening degree), each of the first control valve 41, the second control valve 42, and the third control valve 43 is in a fully closed state and blocks flow of refrigerant.

One end of the first control valve 41 (corresponding to "first shutoff valve" in the claims) is connected to the third pipe P3, and the other end of the first control valve 41 is connected to the fourth pipe P4. The first control valve 41 is disposed in a first gas-side refrigerant flow path GL1 described below. The first control valve 41 controls the flow rate of refrigerant in the first gas-side refrigerant flow path GL1 in accordance with the opening degree thereof, or allows/blocks flow of the refrigerant. The first control valve 41 blocks flow of refrigerant when fully closed.

One end of the second control valve 42 (corresponding to "first shutoff valve" in the claims) is connected to the fifth pipe P5, and the other end of the second control valve 42 is connected to the sixth pipe P6. The second control valve 42 is disposed in a second gas-side refrigerant flow path GL2 described below. The second control valve 42 controls the flow rate of refrigerant in the second gas-side refrigerant flow path GL2 in accordance with the opening degree thereof, or allows/blocks flow of the refrigerant. The second control valve 42 blocks flow of refrigerant when fully closed.

One end of the third control valve 43 (corresponding to "second shutoff valve" in the claims) is connected to the first pipe P1, and the other end of the third control valve 43 is connected to the second pipe P2. The third control valve 43 is disposed in the liquid-side refrigerant flow path LL described below. The third control valve 43 controls the flow rate of refrigerant in the liquid-side refrigerant flow path LL in accordance with the opening degree thereof, or allows/blocks flow of the refrigerant. The third control valve 43 blocks flow of refrigerant when fully closed.

The opening degree of the third control valve 43 of the intermediate unit 40 is controlled to be a two-phase-transport opening degree when the corresponding indoor unit 30 is performing heating operation. Thus, when refrigerant that has passed through the indoor heat exchanger 32 of the corresponding indoor unit 30 and condensed passes through the third control valve 43, the refrigerant is decompressed and becomes gas-liquid two-phase refrigerant. As a result, the refrigerant passes through the third connection pipe 53 in a gas-liquid two-phase state (that is, gas-liquid two-phase transport is performed). That is, in a heating only state or a heating main state, the third control valve 43 also functions as a "decompression valve" for gas-liquid two-phase transport.

When the corresponding indoor unit 30 is performing cooling operation, the third control valve 43 of the intermediate unit 40 is controlled to a noise-suppression opening degree. That is, when gas-liquid two-phase transport is performed, refrigerant flowing toward the cooling indoor unit 30 is transported through the liquid-side refrigerant flow path LL (described below) in a gas-liquid two-phase state. When refrigerant passes through the liquid-side connection pipe LP in a gas-liquid two-phase state, noise may be generated in accordance with the circulation amount and the flow rate of the refrigerant. In order to reduce the noise, the third control valve 43 is disposed, and the third control valve 43 is controlled to a predetermined noise-suppression opening degree when the corresponding indoor unit 30 is performing cooling operation. Thus, the circulation amount or the flow rate of refrigerant that passes through the third control valve 43 is adjusted, thereby reducing noise when the refrigerant passes through the liquid-side connection pipe LP.

The pressure adjusting portion 44 is a unit that is disposed in an indoor-side refrigerant flow path IL described below and that adjusts the pressure of refrigerant in the indoor-side refrigerant flow path IL. The pressure adjusting portion 44 includes the pressure adjusting valve 45 and bypass pipes (the seventh pipe P7 and the eighth pipe P8 described above) for bypassing refrigerant in the indoor-side refrigerant flow path IL to an outdoor-side refrigerant flow path OL described below.

One end of the pressure adjusting valve 45 (corresponding to "bypass mechanism" in the claims) is connected to the seventh pipe P7, and the other end of the pressure adjusting valve 45 is connected to the eighth pipe P8. In other words, the pressure adjusting valve 45 is disposed in the bypass flow path BL (described below) composed of bypass pipes (the seventh pipe P7 and the eighth pipe P8).

When the pressure of refrigerant on one side (the seventh pipe P7 side) of the pressure adjusting valve 45 becomes higher than or equal to a predetermined pressure reference value (a value corresponding to a pressure that may cause damage to pipes and devices of the indoor-side refrigerant flow path IL described below), the pressure adjusting valve 45 opens the bypass flow path BL. The pressure adjusting valve 45 is a mechanical automatic expansion valve including a pressure sensing mechanism for moving a valve disc in accordance with change in pressure applied to one side thereof; and operates in accordance with a pre-calculated pressure reference value. In the present embodiment, the pressure adjusting valve 45 is a general-purpose valve of a known type that can be used for a pressure reference value that is selected in accordance with the specifications (capacity, type, and the like) of pipes and devices the indoor-side refrigerant flow path IL.

When a pressure lower than the pressure reference value is applied to one side of the pressure adjusting valve 45, the valve disc is maintained at a predetermined position due to the elasticity of an elastic member included in the pressure sensing mechanism or the pressure balance of fluid, and thereby the pressure adjusting valve 45 is fully closed. When a pressure higher than or equal to the pressure reference value is applied to one side of the pressure adjusting valve 45, the valve disc moves in accordance with the pressure, and thereby the pressure adjusting valve 45 opens to allow passage of refrigerant from one side to the other end side thereof. That is, the pressure adjusting valve 45 allows refrigerant to pass therethrough when receiving a pressure higher than or equal to the pressure reference value. The pressure adjusting valve 45 does not operate in accordance with the pressure of refrigerant applied from the other side (the eighth pipe P8 side). In the present embodiment, when the pressure of refrigerant in the seventh pipe P7, to be more specific, the pressure of refrigerant in the first pipe P1 (a refrigerant pipe with which one side of the pressure adjusting valve 45 communicates) of an indoor-side liquid-refrigerant flow path IL2 becomes higher than or equal to the pressure reference value, the pressure adjusting valve 45 opens the bypass flow path BL.

The intermediate unit 40 includes the intermediate unit controller (not shown) that controls the states of various devices included in the intermediate unit 40. The intermediate unit controller includes a microcomputer composed of a CPU, a memory, and the like. The intermediate unit controller receives a signal from the outdoor unit controller or the indoor unit controller via communication lines, and, in accordance with conditions, controls the operations and states of various devices included in the intermediate units 40 (here, the opening degrees of the control valves 41, 42, and 43).

(1-4) Outdoor-Side Connection Pipe 50, Indoor-Side Connection Pipe 60

Each of the outdoor-side connection pipes 50 and the indoor-side connection pipes 60 is a refrigerant connection pipe that is set on site by a serviceperson. The length and diameter of each of the outdoor-side connection pipes 50 and the indoor-side connection pipes 60 are appropriately determined in accordance with the setting environment or the design specifications. Each of the outdoor-side connection pipes 50 and the indoor-side connection pipes 60 extends between the outdoor unit 10 and the intermediate unit 40 or between each of the intermediate units 40 and the corresponding indoor unit 30. Each of the outdoor-side connection pipes 50 and the indoor-side connection pipes 60 need not be a single pipe, and may be composed of a plurality of pipes that are connected via joints, opening/closing valves, or the like.

The outdoor-side connection pipes 50 (the first connection pipe 51, the second connection pipe 52, and the third connection pipe 53) extend between the outdoor unit 10 and the intermediate units 40 and connect these units. To be specific, one end of the first connection pipe 51 is connected to the gas-side first shutoff valve 11, and the other end of the first connection pipe 51 is connected to the fourth pipe P4 of each of the intermediate units 40. One end of the second connection pipe 52 is connected to the gas-side second shutoff valve 12, and the other end of the second connection pipe 52 is connected to the sixth pipe P6 of each of the intermediate units 40. One end the third connection pipe 53 is connected to the liquid-side shutoff valve 13, and the other end of the third connection pipe 53 is connected to the second pipe P2 of each of the intermediate units 40.

During operation, the first connection pipe 51 functions as a refrigerant flow path through which low-pressure gas refrigerant flows. During operation, the second connection pipe 52 functions as a refrigerant flow path through which high-pressure gas refrigerant flows, when the third flow-path switching valve 18 is in a first flow path state; and the second connection pipe 52 functions as a refrigerant flow path through which low-pressure gas refrigerant flows, when the third flow-path switching valve 18 is in a second flow path state. During operation, the third connection pipe 53 functions as a refrigerant flow path through which gas-liquid two-phase refrigerant that has been decompressed by a decompression valve (the third outdoor control valve 25/the third control valve 43) flows.

The indoor-side connection pipe 60 (the gas-side connection pipe GP and the liquid-side connection pipe LP) extend between each of the intermediate units 40 and the corresponding indoor unit 30 and connect these. To be specific, one end of the gas-side connection pipe GP is connected to the third pipe P3, and the other end of the gas-side connection pipe GP is connected to a gas-side port of the indoor heat exchanger 32. During operation, the gas-side connection pipe GP functions as a refrigerant flow path through which gas refrigerant flows. One end of the liquid-side connection pipe LP is connected to the first pipe P1, and the other end of the liquid-side connection pipe LP is connected to the indoor expansion valve 31. During operation, the liquid-side connection pipe LP functions as a refrigerant flow path through which liquid refrigerant/gas-liquid two-phase refrigerant flows.

(2) Refrigerant Flow Paths included in Refrigerant Circuit RC

The refrigerant circuit RC includes a plurality of refrigerant flow paths described below.

(2-1) Gas-Side Refrigerant Flow Path GL

The refrigerant circuit RC includes the gas-side refrigerant flow path GL, which is disposed between the outdoor unit 10 and the indoor units 30 (that is, between the outdoor heat exchanger 20 and each of the indoor heat exchangers 32) and through which gas refrigerant flows. The gas-side refrigerant flow path GL is a refrigerant flow path that is composed of the first connection pipe 51 and the second connection pipe 52; the third pipe P3, the fourth pipe P4, the fifth pipe P5, the sixth pipe P6, the first control valve 41, and the second control valve 42 of each of the intermediate units 40; and the gas-side connection pipe GP. In the present embodiment, the intermediate units 40 are each disposed in the gas-side refrigerant flow path GL. The gas-side refrigerant flow path GL is disposed between the outdoor unit 10 and the corresponding indoor unit 30. The gas-side refrigerant flow path GL branches into a plurality of flow paths and extends. To be specific, the gas-side refrigerant flow path GL includes a plurality of "gas-side branch flow paths" (to be more specific, a plurality of first gas-side refrigerant flow paths GL1 and a plurality of second gas-side refrigerant flow paths GL2). Each of the gas-side branch flow paths is disposed between the corresponding indoor unit 30 and the outdoor unit 10.

Each of the first gas-side refrigerant flow paths GL1 (corresponding to "gas-side first branch flow path") is a refrigerant flow path through which low-pressure gas refrigerant flows, and is composed of the third pipe P3, the fourth pipe P4, and the first control valve 41 of the intermediate unit 40. The gas-side refrigerant flow path GL includes a plurality of gas-side first branching portions BP1 that are starting points of the first gas-side refrigerant flow paths GL1.

Each of the second gas-side refrigerant flow path GL2 (corresponding to "gas-side second branch flow path") is a refrigerant flow path through which low-pressure or high-pressure gas refrigerant flows, and is a refrigerant flow path that is composed of the fifth pipe P5, the sixth pipe P6, and the second control valve 42 of each of the intermediate units 40. The second gas-side refrigerant flow path GL2 is a refrigerant flow path that branches off from the first gas-side refrigerant flow path GL1 and extends to the outdoor unit 10, or is a refrigerant flow path that extends from the outdoor unit 10 and joins the first gas-side refrigerant flow path GL1. The gas-side refrigerant flow path GL includes a plurality of gas-side second branching portions BP2 that are starting points of the second gas-side refrigerant flow paths GL2.

(2-2) Liquid-Side Refrigerant Flow Path LL

The refrigerant circuit RC includes a plurality of liquid-side refrigerant flow paths LL, which are disposed between the outdoor unit 10 and the indoor units 30 and through which liquid refrigerant (refrigerant in a saturated liquid state or a subcooled state) or gas-liquid two-phase refrigerant flows. The liquid-side refrigerant flow path LL is a refrigerant flow path that is composed of the third connection pipe 53; the first pipe P1, the second pipe P2, and the third control valve 43 of each of the intermediate units 40; and the liquid-side connection pipe LP. In the present embodiment, the intermediate units 40 are each disposed in the liquid-side refrigerant flow path LL. The liquid-side refrigerant flow path LL is disposed between the outdoor unit 10 and the corresponding indoor unit 30. The liquid-side refrigerant flow path LL branches into a plurality of flow paths and extends. To be specific, the liquid-side refrigerant flow path LL includes a plurality of liquid-side branch flow paths LL1. Each of the liquid-side branch flow paths LL1 is disposed between the corresponding indoor unit 30 and the outdoor unit 10. Each of the liquid-side branch flow paths LL1 is composed of the first pipe P1, the second pipe P2, and the third control valve 43 of the intermediate unit 40. The liquid-side refrigerant flow path LL includes a plurality of liquid-side branching portions BP3 that are starting points of the liquid-side branch flow paths LL1.

(2-3) Outdoor-Side Refrigerant Flow Path OL (Heat-Source-Side Refrigerant Flow Path)

The refrigerant circuit RC includes the outdoor-side refrigerant flow path OL, which is disposed between the outdoor unit 10 and each of the intermediate units 40 (to be more specific, the first control valve 41, the second control valve 42, and the third control valve 43 of each of the intermediate unit 40). The outdoor-side refrigerant flow path OL is a refrigerant flow path that is composed of the first connection pipe 51; the second connection pipe 52; the third connection pipe 53; and the second pipe P2, the fourth pipe P4, and the sixth pipe P6 of each of the intermediate units 40. The outdoor-side refrigerant flow path OL includes an outdoor-side gas-refrigerant flow path OL1 and an outdoor-side liquid-refrigerant flow path OL2. The outdoor-side gas-refrigerant flow path OL1 is disposed between the outdoor heat exchanger 20; and the first control valve 41, the second control valve 42, and the third control valve 43.

The outdoor-side gas-refrigerant flow path OL1 (heat-source-side first refrigerant flow path) is a refrigerant flow path that is composed of the first connection pipe 51 and the second connection pipe 52; and the fourth pipe P4 and the sixth pipe P6 of each of the intermediate units 40. The outdoor-side gas-refrigerant flow path OL1 is disposed between the outdoor unit 10 and the first control valve 41 or the second control valve 42. In other words, the outdoor-side gas-refrigerant flow path OL1 corresponds to the gas-side refrigerant flow path GL that is located between the outdoor unit 10 and the first control valve 41 and the second control valve 42 of each of the intermediate units 40. That is, the outdoor-side gas-refrigerant flow path OL1 is disposed between the outdoor heat exchanger 20, and the first control valve 41 and the second control valve 42.

The outdoor-side liquid-refrigerant flow path OL2 (heat-source-side second refrigerant flow path) is a refrigerant flow path that is composed of the third connection pipe 53, and the second pipe P2 of each of the intermediate units 40. The outdoor-side liquid-refrigerant flow path OL2 is disposed between the third control valve 43 and the outdoor unit 10. In other words, the outdoor-side liquid-refrigerant flow path OL2 corresponds to the liquid-side refrigerant flow path LL that is located between the outdoor unit 10 and the third control valve 43 of each of the intermediate units 40. That is, the outdoor-side liquid-refrigerant flow path OL2 is disposed between the outdoor heat exchanger 20 and the third control valve 43.

(2-4) Indoor-Side Refrigerant Flow Path IL (Utilization-Side Refrigerant Flow Path)

The refrigerant circuit RC includes the indoor-side refrigerant flow path IL, which is disposed between each of the intermediate units 40 (to be more specific, the first control valve 41, the second control valve 42, and the third control valve 43 of each of the intermediate units 40) and the corresponding indoor unit 30 (the indoor heat exchanger 32). The indoor-side refrigerant flow path IL is a refrigerant flow path that is composed of the gas-side connection pipe GP and the liquid-side connection pipe LP between each of the intermediate units 40 and the corresponding indoor unit 30, the first pipe P1, the third pipe P3, and the fifth pipe P5. The indoor-side refrigerant flow path IL includes an indoor-side gas-refrigerant flow path IL1 and an indoor-side liquid-refrigerant flow path IL2.

The indoor-side gas-refrigerant flow path IL1 (utilization-side gas-refrigerant flow path) is a refrigerant flow path that is composed of the gas-side connection pipe GP between each of the intermediate units 40 and the corresponding indoor unit 30, and the third pipe P3 and the fifth pipe P5 of each of the intermediate units 40. In other words, the indoor-side gas-refrigerant flow path IL1 corresponds to the gas-side refrigerant flow path GL that is located between the first control valve 41 and the second control valve 42 of each of the intermediate units 40 and the corresponding indoor unit 30. That is, the indoor-side gas-refrigerant flow path IL1 is disposed between the indoor heat exchanger 32, and the first control valve 41 and the second control valve 42.

The indoor-side liquid-refrigerant flow path IL2 (utilization-side liquid-refrigerant flow path) is a refrigerant flow path that is composed of the liquid-side connection pipe LP between each of the intermediate units 40 and the indoor expansion valve 31 of the corresponding indoor unit 30, and the first pipe P1 of each of the intermediate units 40. In other words, the indoor-side liquid-refrigerant flow path IL2 corresponds to the liquid-side refrigerant flow path IL1 that is located between the third control valve 43 of each of the intermediate units 40 and the corresponding indoor unit 30. That is, the indoor-side liquid-refrigerant flow path IL2 is disposed between the third control valve 43 and the indoor heat exchanger 32.

(2-5) Bypass Flow Path BL

The refrigerant circuit RC includes the bypass flow path BL, which is disposed between the liquid-side refrigerant flow path LL and the gas-side refrigerant flow path GL and which bypasses refrigerant in the liquid-side refrigerant flow path LL to the gas-side refrigerant flow path GL. In other words, the bypass flow path BL is a refrigerant flow path that extends from the indoor-side refrigerant flow path IL (to be more specific, the indoor-side liquid-refrigerant flow path IL2) to the outdoor-side refrigerant flow path OL (to be more specific, the outdoor-side gas-refrigerant flow path OL1). When the pressure of refrigerant in the liquid-side refrigerant flow path LL becomes higher than or equal to a predetermined reference value, the bypass flow path BL bypasses refrigerant in the liquid-side refrigerant flow path LL to another portion to decompress the refrigerant, in order to suppress damage to devices and pipes of the liquid-side refrigerant flow path LL.

The bypass flow path BL is composed of, the seventh pipe P7, the eighth pipe P8, and the pressure adjusting valve 45, of each of the intermediate units 40. In other words, the bypass flow path BL is a refrigerant flow path that is composed of bypass pipes of the pressure adjusting portion 44. The bypass flow path BL is opened or closed by the pressure adjusting valve 45 of the pressure adjusting portion 44.

The bypass flow path BL is a refrigerant flow path that bypasses refrigerant from the indoor-side liquid-refrigerant flow path IL2 (the first pipe P1) to the outdoor-side gas-refrigerant flow path OL1 (the fourth pipe P4) included in the first gas-side refrigerant flow path GL1. To be more specific, if the pressure of refrigerant that flows through the first pipe P1 (or the seventh pipe P7, which communicates with the first pipe P1) becomes higher than or equal to a pressure reference value, the pressure adjusting valve 45 is switched to an open state, and thereby the bypass flow path BL opens. When the bypass flow path BL opens, refrigerant in the first pipe P1 passes through the bypass flow path BL and is bypassed to the fourth pipe P4, flows through the first connection pipe 51, and flows into the gas-side port of the outdoor unit 10. That is, if the pressure of refrigerant in the indoor-side refrigerant flow path IL becomes higher than or equal to a pressure reference value, the pressure adjusting valve 45 bypasses refrigerant in the indoor-side refrigerant flow path IL via the bypass flow path BL to the outdoor-side gas-refrigerant flow path OL1 disposed between the first control valve 41 and the outdoor unit 10.

(3) Flow of Refrigerant in Refrigerant Circuit RC

Hereinafter, flow of refrigerant in the refrigerant circuit RC in each state will be described.

(3-1) Cooling Only State

<A1>

When the air conditioning system 100 is in a cooling only state, refrigerant is sucked into the compressor 15 via the suction pipe Pa and compressed. The compressed high-pressure gas refrigerant passes through the discharge pipe Pb and the first flow-path switching valve 16 or the second flow-path switching valve 17, and flows into the outdoor heat exchanger 20 (the first outdoor heat exchanger 21 or the second outdoor heat exchanger 22). When the refrigerant flowed into the outdoor heat exchanger 20 passes through the outdoor heat exchanger 20, the refrigerant exchanges heat with air supplied by the outdoor fan 28 and condenses. The refrigerant passed through the outdoor heat exchanger 20 passes through the first outdoor control valve 23 or the second outdoor control valve 24, and bifurcates into two parts while passing through the liquid-side pipe Pc.

<A2>

One part of the refrigerant bifurcated in the liquid-side pipe Pc flows into the fourth outdoor control valve 26 and is decompressed in accordance with the opening degree of the fourth outdoor control valve 26. The refrigerant passed through the fourth outdoor control valve 26 flows into the second flow path 272 of the subcooling heat exchanger 27. When passing through the second flow path 272, the refrigerant exchanges heat with refrigerant that passes through the first flow path 271. The refrigerant passed through the second flow path 272 flows into the accumulator 14 and is separated into gas refrigerant and liquid refrigerant in the accumulator 14. The gas refrigerant flowing out of the accumulator 14 flows through the suction pipe Pa and is sucked into the compressor 15 again.

<A3>

The other part of the refrigerant bifurcated in the liquid-side pipe Pc flows into the first flow path 271 of the subcooling heat exchanger 27. When the refrigerant flowed into the first flow path 271 passes through the first flow path 271, the refrigerant exchanges heat with refrigerant that passes through the second flow path 272 and becomes subcooled refrigerant. The refrigerant passed through the first flow path 271 flows into the third outdoor control valve 25, is decompressed to a pressure that is suitable for gas-liquid two-phase transport in accordance with the opening degree of the third outdoor control valve 25, and becomes gas-liquid two-phase refrigerant. The refrigerant passed through the third outdoor control valve 25 passes through the liquid-side shutoff valve 13, flows into the third connection pipe 53 (the liquid-side refrigerant flow path LL; the outdoor-side liquid-refrigerant flow path OL2), and passes through the third connection pipe 53 in a gas-liquid two-phase state. The refrigerant passed through the third connection pipe 53 flows into one of the intermediate units 40 that corresponds to the cooling indoor unit 30.

<A4>

The refrigerant flowed into the intermediate unit 40 that corresponds to the cooling indoor unit 30 flows through the second pipe P2 and flows into the third control valve 43. The refrigerant flowed into the third control valve 43 is decompressed in accordance with the opening degree (noise-suppression opening degree) of the third control valve 43, and then flows into the first pipe P1 (the indoor-side liquid-refrigerant flow path IL2). The refrigerant passed through the first pipe P1 flows out of the intermediate units 40 and flows into the liquid-side connection pipe LP. The refrigerant passed through the liquid-side connection pipe LP flows into the corresponding indoor unit 30. The refrigerant flowed into the cooling indoor unit 30 is decompressed when passing through the indoor expansion valve 31. The refrigerant passed through the indoor expansion valve 31 flows into the indoor heat exchanger 32. When passing through the indoor heat exchanger 32, the refrigerant exchanges heat with air supplied by the indoor fan 33 and evaporates and becomes superheated refrigerant. The refrigerant passed through the indoor heat exchanger 32 flows into the gas-side connection pipe GP (the gas-side refrigerant flow path GL; the indoor-side gas-refrigerant flow path IL1). The refrigerant flowed through the gas-side connection pipe GP flows out of the cooling indoor unit 30 and flows into a corresponding one of the intermediate units 40.

<A5>

The refrigerant flowed into the intermediate unit 40 passes through the first gas-side refrigerant flow path GL1 (a flow path that is composed of the third pipe P3, the first control valve 41, and the fourth pipe P4), or the second gas-side refrigerant flow path GL2 (that is, a flow path that is composed of the fifth pipe P5, the second control valve 42, and the sixth pipe P6), and flows out of the intermediate unit 40. The refrigerant flowed out of the first gas-side refrigerant flow path GL1 of the intermediate unit 40 passes through the first connection pipe 51 (the outdoor-side gas-refrigerant flow path OL1), and flows into the outdoor unit 10 via the gas-side first shutoff valve 11. The refrigerant flowed out of the second gas-side refrigerant flow path GL2 of the intermediate unit 40 passes through the second connection pipe 52 (the outdoor-side gas-refrigerant flow path OL1), and flows into the outdoor unit 10 via the gas-side second shutoff valve 12.

<A6>

The refrigerant flowed into the outdoor unit 10 via the gas-side first shutoff valve 11 or via the gas-side second shutoff valve 12 flows into the accumulator 14, and is separated into gas refrigerant and liquid refrigerant in the accumulator 14. The gas refrigerant flowing out of the accumulator 14 flows through the suction pipe Pa and is sucked into the compressor 15 again.

(3-2) Heating Only State

<B1>

When the air conditioning system 100 is in a heating only state, refrigerant is sucked into the compressor 15 via the suction pipe Pa and compressed. The compressed high-pressure gas refrigerant passes through the discharge pipe Pb, the third flow-path switching valve 18, and the gas-side second shutoff valve 12, and flows into the second connection pipe 52 (the gas-side refrigerant flow path GL; the outdoor-side gas-refrigerant flow path OL1).

<B2>

The refrigerant passed through the second connection pipe 52 flows into one of the intermediate units 40 corresponding to the heating indoor unit 30. The refrigerant flowed into the intermediate unit 40 passes through the second gas-side refrigerant flow path GL2 (that is, the sixth pipe P6, the second control valve 42, and the fifth pipe P5), and flows into the heating indoor unit 30 through the gas-side connection pipe GP (the indoor-side gas-refrigerant flow path IL1).

<B3>

The refrigerant flowed into the heating indoor unit 30 flows into the indoor heat exchanger 32. When passing through the indoor heat exchanger 32, the refrigerant exchanges heat with air supplied by the indoor fan 33 and condenses and becomes liquid refrigerant or gas-liquid two-phase refrigerant. The refrigerant passed through the indoor heat exchanger 32 passes through the indoor expansion valve 31, and then flows into the liquid-side connection pipe LP (the liquid-side refrigerant flow path LL; the indoor-side liquid-refrigerant flow path IL2). The refrigerant passed through the liquid-side connection pipe LP flows into a corresponding one of the intermediate units 40.

<B4>

The refrigerant flowed into the intermediate unit 40 passes through the first pipe P1, and then flows into the third control valve 43. The refrigerant flowed into the third control valve 43 is decompressed in accordance with the opening degree (two-phase-transport opening degree) of the third control valve 43 and enters a gas-liquid two-phase state. The refrigerant passed through the third control valve 43 flows into the second pipe P2 (the outdoor-side liquid-refrigerant flow path OL2) and passes through the third connection pipe 53. The refrigerant passed through the third connection pipe 53 flows into the outdoor unit 10 via the liquid-side shutoff valve 13.

<B5>

The refrigerant flowed into the outdoor unit 10 via the liquid-side shutoff valve 13 passes through the third outdoor control valve 25 and is decompressed in accordance with the opening degree of the third outdoor control valve 25. The refrigerant passed through the third outdoor control valve 25 flows into the first flow path 271 of the subcooling heat exchanger 27. When the refrigerant flowed into the first flow path 271 passes through the first flow path 271, the refrigerant exchanges heat with refrigerant that passes through the second flow path 272 and becomes subcooled liquid refrigerant. The refrigerant passed through the first flow path 271 bifurcates into two parts while flowing through the liquid-side pipe Pc.

One part of the refrigerant bifurcated in the liquid-side pipe Pc flows as described in <A2> and is sucked into the compressor 15 again.

The other part of the refrigerant bifurcated in the liquid-side pipe Pc flows into the first outdoor control valve 23 or the second outdoor control valve 24 and is decompressed in accordance with the opening degree of the first outdoor control valve 23 or the second outdoor control valve 24. The refrigerant passed through the first outdoor control valve 23 or the second outdoor control valve 24 flows into the outdoor heat exchanger 20 (the first outdoor heat exchanger 21 or the second outdoor heat exchanger 22). When the refrigerant flowed into the outdoor heat exchanger 20 passes through the outdoor heat exchanger 20, the refrigerant exchanges heat with air supplied by the outdoor fan 28 and evaporates. The refrigerant passed through the outdoor heat exchanger 20 passes through the first flow-path switching valve 16 or the second flow-path switching valve 17, flows into the accumulator 14, and is separated into gas refrigerant and liquid refrigerant in the accumulator 14. The gas refrigerant flowing out of the accumulator 14 flows through the suction pipe Pa and is sucked into the compressor 15 again.

(3-3) Case where both Cooling Indoor Unit 30 and Heating Indoor Units 30 are present A case where both the cooling indoor unit 30 and the heating indoor unit 30 are present will be described for each of a case where the air conditioning system 100 is in a cooling main state and a case where the air conditioning system 100 is in a cooling/heating balanced state. The case of the cooling/heating balanced state will be described for each of a case where the air conditioning system 100 enters a cooling/heating balanced state from a cooling main state and a case where the air conditioning system 100 enters a cooling/heating balanced state from a heating main state.

(3-3-1) Case of being in Cooling Main State

<C1>

When the air conditioning system 100 is in a cooling main state, refrigerant is sucked into the compressor 15 via the suction pipe Pa and compressed. The compressed high-pressure gas refrigerant bifurcates into two parts while flowing through the discharge pipe Pb.

<C2>

One part of the refrigerant bifurcated while flowing through the discharge pipe Pb passes through the third flow-path switching valve 18 and the gas-side second shutoff valve 12 and flows into the second connection pipe 52 (the gas-side refrigerant flow path GL; the outdoor-side gas-refrigerant flow path OL1). The refrigerant flowed into the second connection pipe 52 flows as described in <B2> and flows into the heating indoor unit 30. The refrigerant flowed into the heating indoor unit 30 flows as described in <B3> and flows into the first pipe P1 of a corresponding one of the intermediate units 40. The refrigerant passes through the first pipe P1, and then flows into the third control valve 43. The refrigerant flowed into the third control valve 43 is decompressed in accordance with the opening degree (two-phase-transport opening degree) of the third control valve 43 and enters a gas-liquid two-phase state. The refrigerant passed through the third control valve 43 flows through the second pipe P2 (the outdoor-side liquid-refrigerant flow path OL2), and then flows into the third connection pipe 53. The refrigerant flowed into the third connection pipe 53 flows into the second pipe P2 of one of the intermediate units 40 corresponding to the cooling indoor unit 30.

<C3>

The refrigerant flowed into the second pipe P2 of one of the intermediate units 40 corresponding to the cooling indoor unit 30 flows as described in <A4>, and flows into the fourth pipe P4 (the first gas-side refrigerant flow path GL1) of a corresponding one of the intermediate units 40. Subsequently, the refrigerant passed through the fourth pipe P4 of the intermediate units 40 passes through the first connection pipe 51, and flows into the outdoor unit 10 via the gas-side first shutoff valve 11. The refrigerant flowed into the outdoor unit 10 via the gas-side first shutoff valve 11 flows as described in <A6>, and is sucked into the compressor 15 again.

<C4>

The other part of the refrigerant bifurcated while flowing through the discharge pipe Pb in <C2> described above passes through the first flow-path switching valve 16 or the second flow-path switching valve 17 and flows into the outdoor heat exchanger 20 (the first outdoor heat exchanger 21 or the second outdoor heat exchanger 22). When the refrigerant flowed into the outdoor heat exchanger 20 passes through the outdoor heat exchanger 20, the refrigerant exchanges heat with air supplied by the outdoor fan 28 and condenses. The refrigerant passed through the outdoor heat exchanger 20 passes through the first outdoor control valve 23 or the second outdoor control valve 24, and then bifurcates into two parts while flowing through the liquid-side pipe Pc.

<C5>

One part of the refrigerant bifurcated in the liquid-side pipe Pc flows as described in <A2>, and is sucked into the compressor 15 again. The other part of the refrigerant bifurcated in the liquid-side pipe Pc flows as described in <A3>, and flows into the second pipe P2 of one of the cooling indoor units 30 corresponding to the intermediate unit 40. The refrigerant flows as described in <A4>, evaporates in the indoor unit 30, and becomes gas refrigerant. Then, the gas refrigerant passes through the gas-side connection pipe GP (the gas-side refrigerant flow path GL; the indoor-side gas-refrigerant flow path IL1), and flows into the first gas-side refrigerant flow path GL1 of the intermediate unit 40.

<C6>

The refrigerant flowed into the first gas-side refrigerant flow path GL1 of the intermediate unit 40 flows as described in <A5>, and flows into the outdoor unit 10 via the gas-side second shutoff valve 12. The refrigerant passed through the gas-side second shutoff valve 12 and flowed into the outdoor unit 10 flows as described in <A6>, and is sucked into the compressor 15 again.

(3-3-2) Case of being in Heating Main State

<D1>

When the air conditioning system 100 is in a heating main state, refrigerant is sucked into the compressor 15 via the suction pipe Pa, flows as described in <B2>, and flows into the second connection pipe 52. The refrigerant flowed into the second connection pipe 52 flows as described in <B2> and flows into the heating indoor unit 30. The refrigerant flowed into the heating indoor unit 30 flows as described in <B3>, and flows into the first pipe P1 of a corresponding one of the intermediate units 40. The refrigerant passes through the first pipe P1, and then flows into the third control valve 43. The refrigerant flowed into the third control valve 43 is decompressed in accordance with the opening degree (two-phase-transport opening degree) of the third control valve 43 and enters a gas-liquid two-phase state. The refrigerant passed through the third control valve 43 flows through the second pipe P2 (the outdoor-side liquid-refrigerant flow path OL2) and flows into the third connection pipe 53.

<D2>

A part of the refrigerant flowed into the third connection pipe 53 flows into the second pipe P2 of one of the intermediate units 40 corresponding to the cooling indoor unit 30. The refrigerant flows as described in <A4>, and flows into the fourth pipe P4 (the first gas-side refrigerant flow path GL1) of a corresponding one of the intermediate units 40. Subsequently, the refrigerant passed through the fourth pipe P4 of the intermediate unit 40 flows through the first connection pipe 51, and then flows into the outdoor unit 10 via the gas-side first shutoff valve 11. The refrigerant flowed into the outdoor unit 10 via the gas-side first shutoff valve 11 flows as described in <A6>, and is sucked into the compressor 15 again.

<D3>

The other part of the refrigerant flowed into the third connection pipe 53 flows into the outdoor unit 10 via the liquid-side shutoff valve 13. The refrigerant flowed into the outdoor unit 10 via the liquid-side shutoff valve 13 flows as described in <B5>, and is sucked into the compressor 15 again.

(3-3-3) Case of being in Cooling/Heating Balanced State (3-3-3-1) Case of entering Cooling/Heating Balanced State from Cooling Main State When the air conditioning system 100 enters a cooling/heating balanced state from a cooling main state, the refrigerant flows in the refrigeration circuit RC as described in <C1> to <C6> of "(3-3-1) Case of being in Cooling Main State".

(3-3-3-2) Case of entering Cooling/Heating Balanced State from Heating Main State

<E1>

When the air conditioning system 100 enters a cooling/heating balanced state from a heating main state, refrigerant is sucked into the compressor 15 via the suction pipe Pa and compressed. The compressed high-pressure gas refrigerant bifurcates into two parts while passing through the discharge pipe Pb.

<E2>

One part of the refrigerant bifurcated while flowing through the discharge pipe Pb flows as described in <C2> to <C3> and is sucked into the compressor 15 again.

<E3>

The other part of the refrigerant bifurcated while flowing through the discharge pipe Pb in <E2> described above passes through the discharge pipe Pb and the first flow-path switching valve 16, and flows into the outdoor heat exchanger 20 (the second outdoor heat exchanger 22). When the refrigerant flowed into the outdoor heat exchanger 20 passes through the outdoor heat exchanger 20, the refrigerant exchanges heat with air supplied by the outdoor fan 28 and condenses. The refrigerant passed through the outdoor heat exchanger 20 passes through the second outdoor control valve 24, and then bifurcates into two parts while flowing through the liquid-side pipe Pc.

<E4>

One part of the refrigerant bifurcated in the liquid-side pipe Pc flows as described in <A2>, and is sucked into the compressor 15 again.

<E5>

The other part of the refrigerant bifurcated in the liquid-side pipe Pc flows as described in <A3>, and flows into the second pipe P2 of one of the cooling indoor units 30 corresponding to the intermediate unit 40. The refrigerant flows as described in <A4>, and flows into the fourth pipe P4 (the first gas-side refrigerant flow path GL1) of a corresponding one of the intermediate units 40. Subsequently, the refrigerant passed through the fourth pipe P4 of the intermediate unit 40 passes through the first connection pipe 51 and the gas-side first shutoff valve 11, and flows into the outdoor unit 10. The refrigerant passed through the gas-side first shutoff valve 11 and flowed into the outdoor unit 10 flows as described in <A6>, and is sucked into the compressor 15 again.

(3-4) Case where First Control Valve 41, Second Control Valve 42, and Third Control Valve 43 are Simultaneously Closed When the first control valve 41, the second control valve 42, and the third control valve 43 are simultaneously closed, the indoor-side refrigerant flow path IL is blocked, and thereby a liquid seal circuit is formed if refrigerant is present in the indoor-side refrigerant flow path IL. In this case, if the state of refrigerant in the indoor-side refrigerant flow path IL changes and thereby a pressure higher than or equal to a pressure reference value is applied to one side of the pressure adjusting valve 45, the pressure adjusting valve 45 is switched from a fully closed state to an open state and the bypass flow path BL opens. Thus, the refrigerant in the indoor-side refrigerant flow path IL flows into the bypass flow path BL from the first pipe P1, flows through the bypass flow path BL (the seventh pipe P7, the pressure adjusting valve 45, and the eighth pipe P8), and is bypassed to the outdoor-side refrigerant flow path OL (the fourth pipe P4 of the outdoor-side gas-refrigerant flow path OL1).

In this case, even if the opening degree of the indoor expansion valve 31 is the minimum, the indoor expansion valve 31 is slightly open. Therefore, the indoor-side gas-refrigerant flow path IL1 and the indoor-side liquid-refrigerant flow path IL2 communicate with each other via a very small flow path in the indoor expansion valve 31.

(4) Regarding Pressure Adjustment Function and Liquid-Seal-Circuit Prevention Function In the air conditioning system 100, the first control valve 41, the second control valve 42, and the third control valve 43 may become simultaneously fully closed (and block flow of refrigerant).

For example, in order to suppress refrigerant leakage from a stopped indoor unit 30, the first control valve 41, the second control valve 42, and the third control valve 43 in the intermediate unit 40 may be simultaneously switched to fully closed states to block flow of refrigerant into the stopped indoor unit 30. Moreover, for example, if refrigerant leakage occurs in the refrigerant circuit RC, in order to suppress leakage of refrigerant from the indoor unit 30 to a target space, the first control valve 41, the second control valve 42, and the third control valve 43 in the intermediate unit 40 may be simultaneously switched to fully closed states. Furthermore, for example, the valves (41, 42, and 43) may be simultaneously fully closed due to an electric power failure such as blackout, an operation failure due to a product defect or aging degradation, control failure due to an error or the like of a control program, or the like.

In such a case, a liquid seal circuit may be formed in the indoor-side refrigerant flow path IL and breakage of a pipe or a device may occur. In particular, when the air conditioning system 100 is installed on site, the intermediate units 40 are generally disposed near the corresponding indoor unit 30. Therefore, since the length of the liquid-side connection pipe LP is not usually large, a liquid seal circuit is likely to be formed in the indoor-side liquid-refrigerant flow path IL2 if the indoor expansion valve 31 is fully closed.

In consideration of such a risk, with the intermediate units 40 or the air conditioning system 100, because the pressure adjusting portion 44 is disposed in the refrigerant circuit RC, even if the valves (41, 42, and 43) of the intermediate unit 40 are simultaneously fully closed, the bypass flow path BL is opened as pressure in the indoor-side liquid-refrigerant flow path IL2 rises and the pressure is automatically adjusted, and therefore occurrence of breakage of a pipe or a device, due to formation of a liquid seal circuit in the indoor-side liquid-refrigerant flow path IL2, is reduced.

In a closed state (minimum opening degree), the indoor expansion valve 31 is slightly open and forms a very small flow path that allows a very small amount of refrigerant to pass therethrough, and is not fully closed even when the opening degree is the minimum. Thus, even if the valves (41, 42, and 43) of the intermediate unit 40 are simultaneously fully closed, formation of a liquid seal circuit in the indoor-side gas-refrigerant flow path IL1 and the indoor-side liquid-refrigerant flow path IL2 is reduced.

(5) Features (5-1)

An example of a refrigeration apparatus known in the art includes, in a refrigerant circuit including a heat-source-side heat exchanger and a plurality of utilization-side heat exchangers, a switching valve, for switching flow of refrigerant, in each of a gas-side refrigerant flow path and a liquid-side refrigerant flow path disposed between the heat-source-side heat exchanger and each of the utilization-side heat exchangers. The refrigeration apparatus individually switches the direction of flow of refrigerant to each of the utilization-side heat exchangers by individually controlling the states of the switching valves.

However, with the refrigeration apparatus, which includes a shutoff valve in each of the gas-side refrigerant flow path and the liquid-side refrigerant flow path between the heat-source-side heat exchanger and each of the utilization-side heat exchangers, it may occur that the shutoff valves are simultaneously fully closed (flow of refrigerant is blocked). For example, if refrigerant leakage is detected, the shutoff valves disposed in the gas-side refrigerant flow path and the liquid-side refrigerant flow path are controlled to be simultaneously fully closed. Moreover, for example, it may occur that the shutoff valves are simultaneously fully closed due to power supply failure, such as a blackout, malfunctioning of a switching valve, or the like.

In the refrigeration apparatus described above, when the shutoff valves disposed in the gas-side refrigerant flow path and the liquid-side refrigerant flow path are simultaneously fully closed, flow of refrigerant in refrigerant flow paths disposed between the utilization-side heat exchangers and the shutoff valves is blocked, and a liquid seal circuit may be formed. If the liquid seal circuit is formed, damage to a pipe or a device may occur in accordance with a change in the state of refrigerant in the liquid seal circuit and may lead to decrease in reliability.

In contrast, in the air conditioning system 100 according to the embodiment, decrease in reliability is reduced.

The air conditioning system 100 according to the embodiment, which performs a refrigeration cycle in the refrigerant circuit RC, includes the outdoor heat exchanger 20 (corresponding to "heat-source-side heat exchanger"), the indoor heat exchanger 32 (corresponding to "utilization-side heat exchanger"), a "first shutoff valve" (each of the first control valve 41 and the second control valve 42), a "second shutoff valve" (the third control valve 43), and the pressure adjusting portion 44. The first shutoff valve (41, 42) is disposed in the gas-side refrigerant flow path GL. The gas-side refrigerant flow path GL is disposed between the outdoor heat exchanger 20 and the indoor heat exchanger 32. The first shutoff valve (41, 42) blocks flow of refrigerant when fully closed. The second shutoff valve (43) is disposed in the liquid-side refrigerant flow path LL. The liquid-side refrigerant flow path LL is disposed between the outdoor heat exchanger 20, and the indoor heat exchanger 32. The second shutoff valve (43) blocks flow of refrigerant when fully closed. The pressure adjusting portion 44 adjusts the pressure of refrigerant in the indoor-side refrigerant flow path IL (corresponding to "utilization-side refrigerant flow path"). The indoor-side refrigerant flow path IL is disposed between the first shutoff valve (41, 42) or the second shutoff valve (43) and the indoor heat exchanger 32. The pressure adjusting portion 44 includes the pressure adjusting valve 45 (corresponding to "bypass mechanism"). The pressure adjusting valve 45 bypasses refrigerant in the indoor-side refrigerant flow path IL to the outdoor-side refrigerant flow path OL (corresponding to "heat-source-side refrigerant flow path"). The outdoor-side refrigerant flow path OL is disposed between the first shutoff valve (41, 42) or the second shutoff valve (the third control valve 43) and the outdoor heat exchanger 20.

This structure reduces blocking of flow of refrigerant in the indoor-side refrigerant flow path IL between the outdoor heat exchanger 20 and the indoor heat exchanger 32, and thereby reduces formation of a liquid seal circuit, even when the first shutoff valve (41, 42) and second shutoff valve (43) are simultaneously fully closed in a flow path switching unit. Thus, decrease in reliability is reduced.

(5-2)

In the embodiment, the pressure adjusting portion 44 further includes the bypass pipe (P7, P8). The bypass pipe (P7, P8) forms the bypass flow path BL. The bypass flow path BL is a refrigerant flow path that extends from the indoor-side refrigerant flow path IL (corresponding to "utilization-side refrigerant flow path") to the outdoor-side refrigerant flow path OL (corresponding to "heat-source-side refrigerant flow path"). The pressure adjusting valve 45 (corresponding to "bypass mechanism") is disposed in the bypass flow path BL. The pressure adjusting valve 45 opens the bypass flow path when the pressure of refrigerant in the indoor-side refrigerant flow path IL becomes higher than or equal to a predetermined reference value.

Thus, it is possible to form the pressure adjusting portion 44 with a simple structure. Thus, decrease in reliability is reduced while reducing increase in costs.

Here, the term "predetermined reference value" refers to a value that may lead to damage to a pipe or a device of the indoor-side refrigerant flow path IL, and is appropriately selected in accordance with the specifications (capacity, type, and the like) and the arrangement of pipes and devices of the indoor-side refrigerant flow path IL.

(5-3)

In the embodiment, the pressure adjusting valve 45 (corresponding to "bypass mechanism") includes a pressure sensing mechanism that allows refrigerant to pass therethrough when receiving a pressure higher than or equal to the pressure reference value. Thus, it is possible to form the pressure adjusting portion 44 with a particularly simple structure, and increase in costs is reduced.

(5-4)

In the embodiment, the bypass flow path BL extends from the indoor-side refrigerant flow path IL (corresponding to "utilization-side refrigerant flow path") to the outdoor-side gas-refrigerant flow path OL1 (corresponding to a heat-source-side first refrigerant flow path). The outdoor-side gas-refrigerant flow path OL1 is a refrigerant flow path disposed between the first shutoff valve (each of the first control valve 41 and the second control valve 42) and the outdoor heat exchanger 20 (corresponding to "heat-source-side heat exchanger"). Thus, even when the first shutoff valve (41, 42) and the second shutoff valve (43) are simultaneously fully closed in the air conditioning system 100, refrigerant in the indoor-side refrigerant flow path IL is bypassed to the outdoor-side gas-refrigerant flow path OL1.

(5-5)

In the embodiment, the air conditioning system 100 further includes the indoor expansion valve 31 (corresponding to "electric expansion valve") disposed in a refrigerant flow path between the indoor heat exchanger 32 (corresponding to "utilization-side heat exchanger") and the second shutoff valve (the third control valve 43). The indoor expansion valve 31 decompresses refrigerant that passes therethrough in accordance with the opening degree thereof. The indoor expansion valve 31 allows the refrigerant to pass therethrough even when the first shutoff valve (the first control valve 41 and the second control valve 42) and the second shutoff valve (the third control valve 43) are fully closed.

Thus, even when the first shutoff valves (41, 42) and the second shutoff valve (43) are simultaneously fully closed, irrespective of the state of the indoor expansion valve 31 in the indoor unit 30, flow of refrigerant in the indoor-side refrigerant flow path IL (corresponding to "utilization-side refrigerant flow path") is blocked, and formation of a liquid seal circuit is reduced. In particular, the distance between the second control valve 42 and the indoor expansion valve 31 in the indoor unit 30 is generally not large at installation sites. Therefore, a liquid seal circuit tends to be formed in the indoor-side liquid-refrigerant flow path IL2 between the second control valve 42 and the indoor expansion valve 31, if both of the valves 42 and 31 are simultaneously fully closed. However, formation of a liquid seal circuit in such a manner is reduced.

(5-6)

The air conditioning system 100 according to the embodiment includes the compressor 15 that compresses refrigerant and the accumulator 14 that stores refrigerant. The compressor 15 is disposed in a refrigerant flow path between the outdoor heat exchanger 20 (corresponding to "heat-source-side heat exchanger") and the first shutoff valve (the first control valve 41 and the second control valve 42). The accumulator 14 disposed on the suction side of the compressor 15.

Thus, when the first shutoff valves (41, 42) and the second shutoff valve (43) are simultaneously fully closed in the air conditioning system 100, bypassed refrigerant is stored in the accumulator 14. Thus, occurrence of a liquid backflow phenomenon, in which liquid refrigerant is sucked into the compressor 15, is reduced.

(5-7)

In the embodiment, the air conditioning system 100 includes the outdoor unit 10 (corresponding to "heat source unit"), the plurality of indoor units 30 (corresponding to "utilization units"), and the intermediate unit 40. The outdoor heat exchanger 20 (corresponding to "heat-source-side heat exchanger") is disposed in the outdoor unit 10. The indoor heat exchanger 32 (corresponding to "utilization-side heat exchanger") is disposed in each of the plurality of indoor units 30. The plurality of indoor units 30 are arranged in parallel with the outdoor unit 10. The intermediate unit 40 is disposed in the gas-side refrigerant flow path GL and the liquid-side refrigerant flow path LL. The gas-side refrigerant flow path GL is disposed between the corresponding indoor unit 30 and the outdoor unit 10. The liquid-side refrigerant flow path LL is disposed between the corresponding indoor unit 30 and the outdoor unit 10. The intermediate unit 40 switches flow of refrigerant in the corresponding indoor unit 30. The first shutoff valve (the first control valve 41 and the second control valve 42) is disposed in the intermediate unit 40. The second shutoff valve (the third control valve 43) is disposed in the intermediate unit 40. The pressure adjusting portion 44 is disposed in the intermediate unit 40.

Thus, in the intermediate unit 40 disposed in a refrigerant flow path (the gas-side refrigerant flow path GL and the liquid-side refrigerant flow path LL) disposed between the outdoor unit 10 and each of the indoor units 30, formation of a liquid seal circuit is reduced, and decrease in reliability is reduced.

(5-8)

In the embodiment, the gas-side refrigerant flow path GL includes a plurality of "gas-side branch flow paths" (GL1, GL2). Each of the gas-side branch flow paths (GL1, GL2) branches off and is disposed between the outdoor unit 10 and a corresponding one of the indoor units 30. The "gas-side branch flow paths" includes the first gas-side refrigerant flow path GL1 (corresponding to "first gas-side branch flow path" and the second gas-side refrigerant flow path GL2 (corresponding to "second gas-side branch flow path"). Low-pressure gas refrigerant flows in the first gas-side refrigerant flow path GL1. The second gas-side refrigerant flow path GL2 branches off from the first gas-side refrigerant flow path GL1 and extends to the outdoor unit 10. Low-pressure/high-pressure gas refrigerant flows in the second gas-side refrigerant flow path GL2. The first shutoff valve (the first control valve 41 and the second control valve 42) are respectively disposed in the first gas-side refrigerant flow path GL1 and the second gas-side refrigerant flow path GL2 of each of the gas-side branch flow paths.

Thus, also when the intermediate unit 40 is disposed in each of three refrigerant flow paths (the first gas-side refrigerant flow path GL1, the second gas-side refrigerant flow path GL2, and the liquid-side refrigerant flow path LL) that are disposed between the outdoor unit 10 and each of the indoor units 30, formation of a liquid seal circuit is reduced, and decrease in reliability is reduced.

(6) Modifications

The embodiment may be appropriately modified as shown in the modifications described below. Any of these modifications may be used in combination with another modification unless contradictory.

(6-1) First Modification

In the embodiment, the bypass flow path BL extends from the indoor-side liquid-refrigerant flow path IL2 in the intermediate unit 40 to the outdoor-side gas-refrigerant flow path OL1. That is, in the embodiment, the seventh pipe P7 of the bypass flow path BL is connected to the first pipe P1 of the indoor-side liquid-refrigerant flow path IL2 in the intermediate unit 40. However, irrespective of whether the seventh pipe P7 of the bypass flow path BL is connected to the first pipe P1, the seventh pipe P7 may be connected to another refrigerant pipe of the indoor-side liquid-refrigerant flow path IL2 outside the intermediate unit 40.

For example, the seventh pipe P7 may be connected to the liquid-side connection pipe LP (the indoor-side liquid-refrigerant flow path IL2) that extends to the corresponding indoor unit 30. Alternatively, for example, the seventh pipe P7 may be connected to a refrigerant pipe (the indoor-side liquid-refrigerant flow path IL2) that connects the indoor expansion valve 31 and the liquid-side connection pipe LP of the corresponding indoor unit 30. In this case, although the bypass flow path BL extends from the indoor-side liquid-refrigerant flow path IL2 outside the intermediate unit 40 to the outdoor-side gas-refrigerant flow path OL1 in the intermediate unit 40, the advantageous effects described in (5-1) can be realized.

(6-2) Second Modification

In the embodiment, the bypass flow path BL extends from the indoor-side liquid-refrigerant flow path IL2 to the outdoor-side gas-refrigerant flow path OL1 in the intermediate unit 40. That is, in the embodiment, the eighth pipe P8 of the bypass flow path BL is connected to the fourth pipe P4 of the outdoor-side gas-refrigerant flow path OL1 in the intermediate unit 40. However, irrespective of whether the eighth pipe P8 of the bypass flow path BL is connected to the fourth pipe P4, the eighth pipe P8 of the bypass flow path BL may be connected to another refrigerant pipe of the outdoor-side gas-refrigerant flow path OL1.

Figure 4:
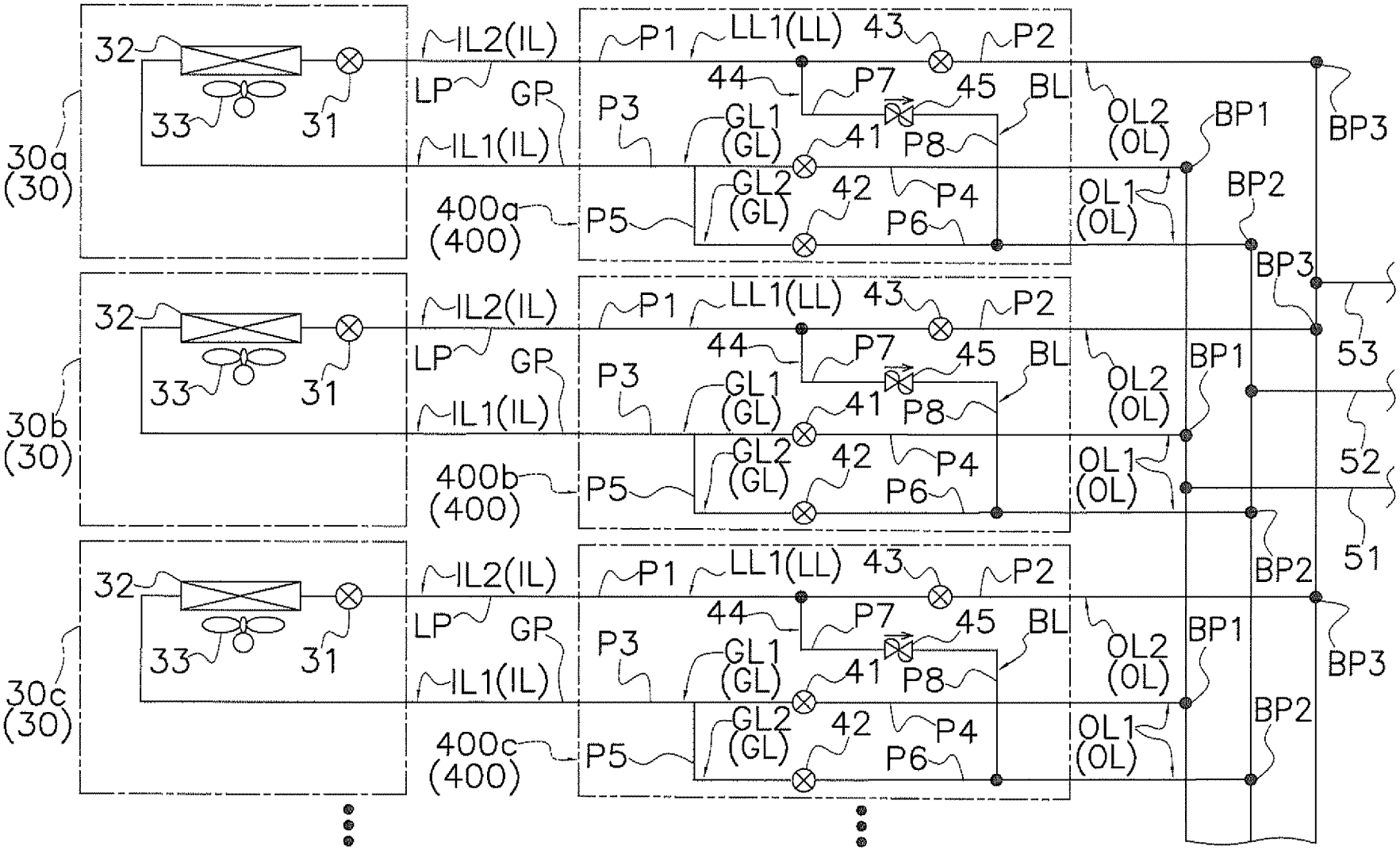
FIG. 4 illustrates a refrigerant circuit including a bypass flow path according to a second modification.

For example, as in each of intermediate units 400 (400*a*, 400*b*, 400*c* . . . ) shown in FIG. 4, the eighth pipe P8 may be connected to the sixth pipe P6 of the outdoor-side gas-refrigerant flow path OL1 in the intermediate unit 400. In this case, although refrigerant in the indoor-side liquid-refrigerant flow path IL2 is bypassed to the second gas-side refrigerant flow path GL2, the advantageous effects described in (5-1) are realized.

Alternatively, for example, the eighth pipe P8 may be connected to the first connection pipe 51 or the second connection pipe 52 of the outdoor-side gas-refrigerant flow path OL1 outside the intermediate unit 40. In this case, although refrigerant in the indoor-side liquid-refrigerant flow path IL2 is bypassed to the outdoor-side gas-refrigerant flow path OL1 outside the intermediate unit 40, the advantageous effects described in (5-1) can be realized.

(6-3) Third Modification

In the embodiment, the bypass flow path BL extends from the indoor-side liquid-refrigerant flow path IL2 to the outdoor-side gas-refrigerant flow path OL1. That is, in the embodiment, the eighth pipe P8 of the bypass flow path BL is connected to the fourth pipe P4 of the outdoor-side refrigerant flow path OL in the intermediate unit 40. However, irrespective of whether the eighth pipe P8 of the bypass flow path BL is connected to the fourth pipe P4, the eighth pipe P8 may be connected to another refrigerant pipe of the outdoor-side refrigerant flow path OL.

Figure 5:
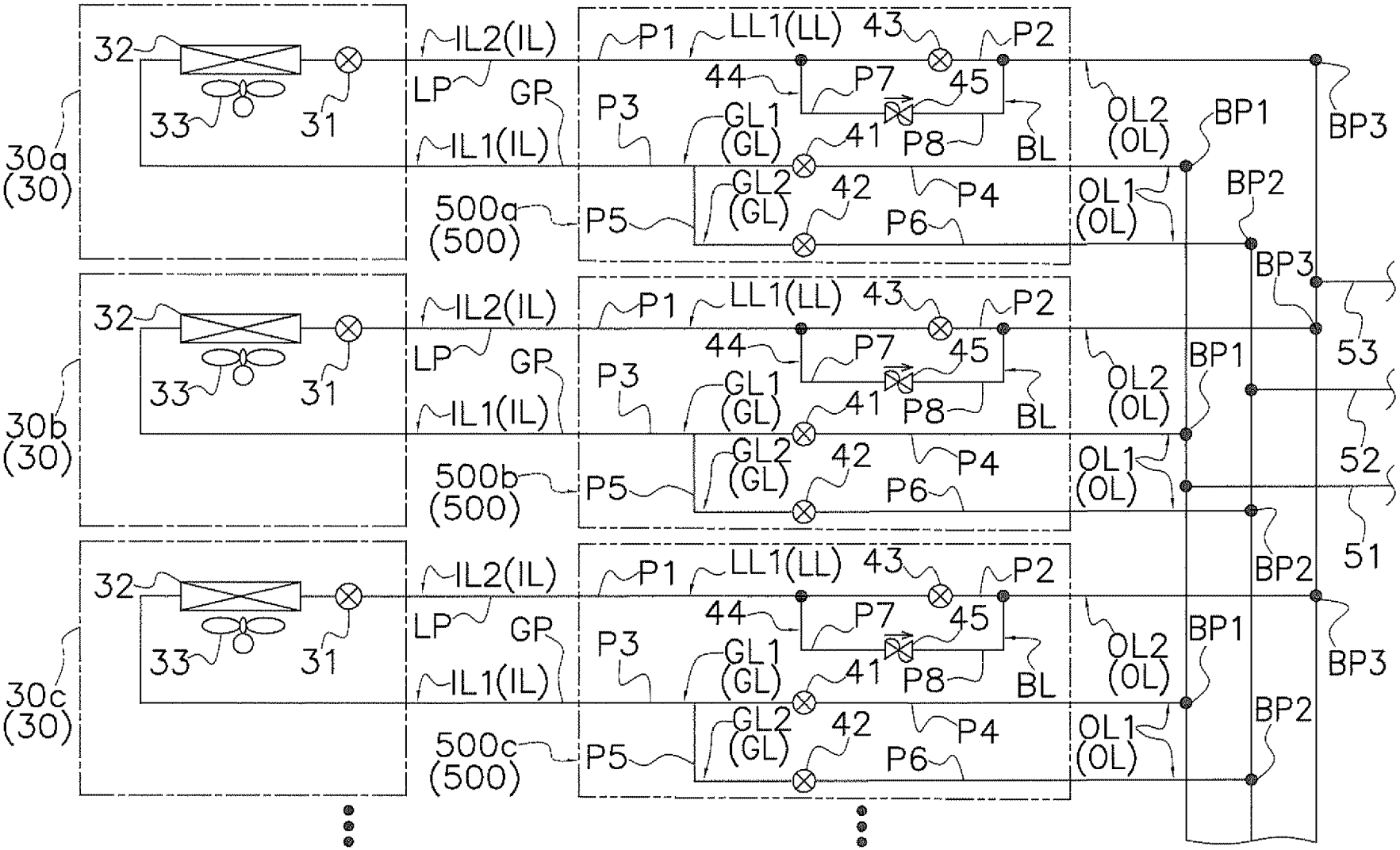
FIG. 5 illustrates a refrigerant circuit including a bypass flow path according to a third modification.

For example, as in each of intermediate units 500 (500*a*, 500*b*, 500*c* . . . ) shown in FIG. 5, the eighth pipe P8 may be connected to the second pipe P2 of the outdoor-side liquid-refrigerant flow path OL2 in the intermediate unit 500. Alternatively, for example, the eighth pipe P8 may be connected to the third connection pipe 53 of the outdoor-side liquid-refrigerant flow path OL2 outside the intermediate unit 500. In this case, the bypass flow path BL extends to the outdoor-side liquid-refrigerant flow path OL2 (corresponding to "heat-source-side second refrigerant flow path") disposed between the second shutoff valve (the third control valve 43) and the outdoor heat exchanger 20 (corresponding to "heat-source-side heat exchanger"). In this case, even when the first shutoff valve (41, 42) and the second shutoff valve (43) are simultaneously fully closed in the intermediate unit 40, refrigerant in the indoor-side refrigerant flow path IL (corresponding to "utilization-side refrigerant flow path") is bypassed to the outdoor-side liquid-refrigerant flow path OL2. That is, advantageous effects described in (5-1) can be realized.

In this case, because refrigerant is bypassed to the liquid-side refrigerant flow path LL, preferably, a receiver for storing the bypassed refrigerant is disposed at a predetermined position in the outdoor unit 10 (for example, in the liquid-side pipe Pc).

(6-4) Fourth Modification

In the embodiment, the bypass flow path BL extends from the indoor-side liquid-refrigerant flow path IL2 to the outdoor-side gas-refrigerant flow path OL1. That is, in the embodiment, the seventh pipe P7 of the bypass flow path BL is connected to the first pipe P1 of the indoor-side liquid-refrigerant flow path IL2, and the eighth pipe P8 of the bypass flow path BL is connected to the fourth pipe P4 of the outdoor-side gas-refrigerant flow path OL1. However, instead of or in addition to the bypass flow path BL structured as described above, the pressure adjusting portion 44 may include a bypass flow path having another structure.

Figure 6:
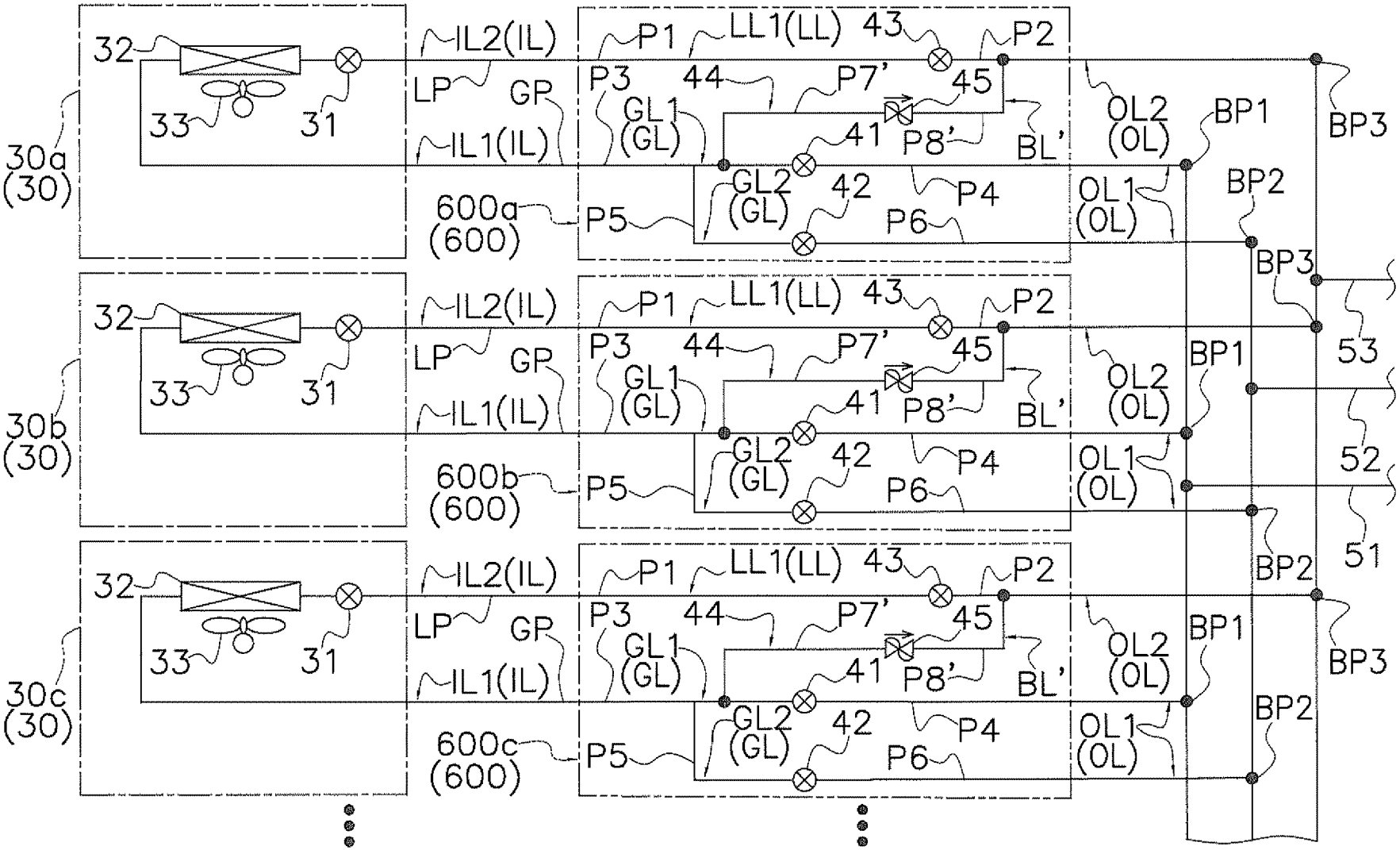
FIG. 6 illustrates a refrigerant circuit including a bypass flow path according to a fourth modification.

For example, as in each of intermediate units 600 (600*a*, 600*b*, 600*c* . . . ) shown in FIG. 6, may include a bypass flow path BL' that is formed by connecting a seventh pipe P7' to the gas-side refrigerant flow path GL (the first gas-side refrigerant flow path GL1) and the third pipe P3 of the indoor-side gas-refrigerant flow path IL1 and by connecting an eighth pipe P8' to the liquid-side refrigerant flow path LL and the second pipe P2 of the outdoor-side liquid-refrigerant flow path OL2. In this case, the bypass flow path BL' extends from the indoor-side gas-refrigerant flow path IL1 to the outdoor-side liquid-refrigerant flow path OL2, and refrigerant in the indoor-side gas-refrigerant flow path IL1 is bypassed to the outdoor-side liquid-refrigerant flow path OL2 (the liquid-side refrigerant flow path LL). The refrigerant bypassed in this way is recovered via the liquid-side port of the outdoor unit 10 (the liquid-side shutoff valve 13). When the bypass flow path BL' is provided, because refrigerant is bypassed to the liquid-side refrigerant flow path LL, preferably, a receiver for storing the bypassed refrigerant is disposed at a predetermined position (for example, in the liquid-side pipe Pc) in the outdoor unit 10.

The seventh pipe P7' of the bypass flow path BL' may be connected to another pipe of the indoor-side gas-refrigerant flow path IL1 (for example, the fifth pipe P5 or the gas-side connection pipe GP). The eighth pipe P8' of the bypass flow path BL' may be connected to another pipe of the outdoor-side liquid-refrigerant flow path OL2 (for example, the third connection pipe 53). Alternatively, the eighth pipe P8' of the bypass flow path BL' may be connected to another pipe of the outdoor-side gas-refrigerant flow path OL1 (for example, the fourth pipe P4, the sixth pipe P6, the first connection pipe 51, or the second connection pipe 52).

By forming the bypass flow path BL' in the pressure adjusting portion 44, refrigerant in the indoor-side gas-refrigerant flow path IL1 is bypassed to the outdoor-side refrigerant flow path OL, and advantageous effects described in (5-1) can be realized.

(6-5) Fifth Modification

Figure 7:
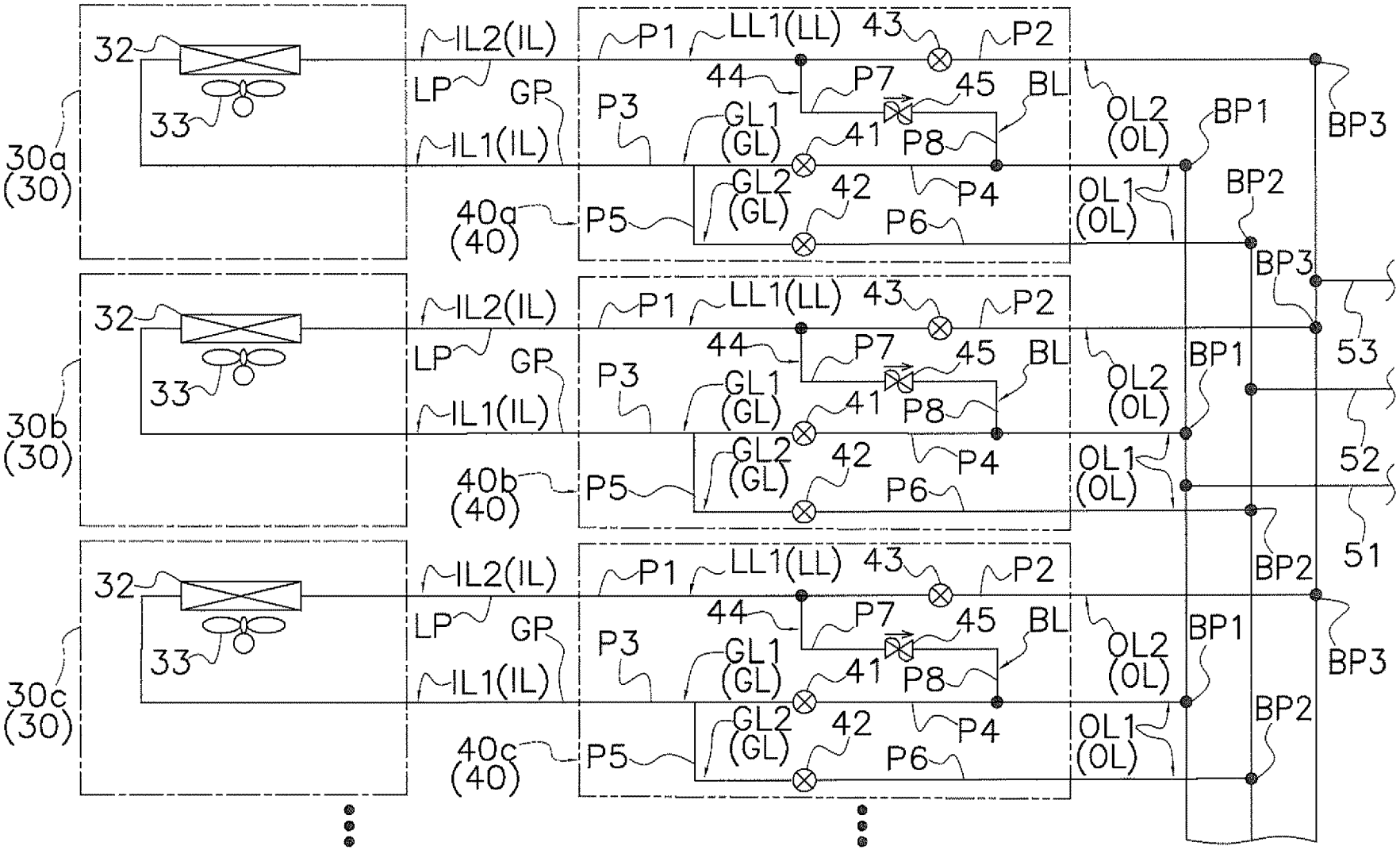
FIG. 7 illustrates a refrigerant circuit according to a fifth modification.

The indoor expansion valve 31 in the embodiment is not necessary and may be omitted as shown in FIG. 7. In this case, the third control valve 43 may function as the indoor expansion valve 31 ("electric expansion valve"). Also in this case, advantageous effects described in (5-1) can be realized.

(6-6) Sixth Modification

Although not illustrated, the third control valve 43 in the embodiment is not necessary and may be omitted. In this case, a valve that can be fully closed in a closed state and block flow of refrigerant is used as the indoor expansion valve 31, so that the indoor expansion valve 31 can function as the third control valve 43 ("second shutoff valve"). In this case, when the bypass flow path BL is formed as illustrated in FIGS. 3, 4, 5, and other figures, one end of the seventh pipe P7 (bypass pipe) may be connected to a refrigerant flow path between the indoor expansion valve 31 and the indoor heat exchanger 32. Also in this case, advantageous effects described in (5-1) can be realized.

(6-7) Seventh Modification

In the embodiment, the indoor expansion valve 31 is an electric valve that is slightly open and forms a very small flow path in a closed state (minimum opening degree). In view of reducing formation of a liquid seal circuit in the indoor-side refrigerant flow path IL, such an electric valve is preferably used as the indoor expansion valve 31. However, unless a problem arises, the indoor expansion valve 31 need not be such an expansion valve. That is, the indoor expansion valve 31 may be a valve that is fully closed and block flow of refrigerant when the opening degree is minimum.

In this case, even if the indoor expansion valve 31 and the third control valve 43 are simultaneously fully closed and the pressure of refrigerant in the indoor expansion valve 31 and the third control valve 43 becomes higher than or equal to a pressure reference value, the pressure adjusting portion 44 bypasses refrigerant in the indoor-side liquid-refrigerant flow path IL2 to the outdoor-side gas-refrigerant flow path OL1, and therefore breakage of a device or a pipe of the indoor-side liquid-refrigerant flow path IL2 is reduced.

Figure 8:
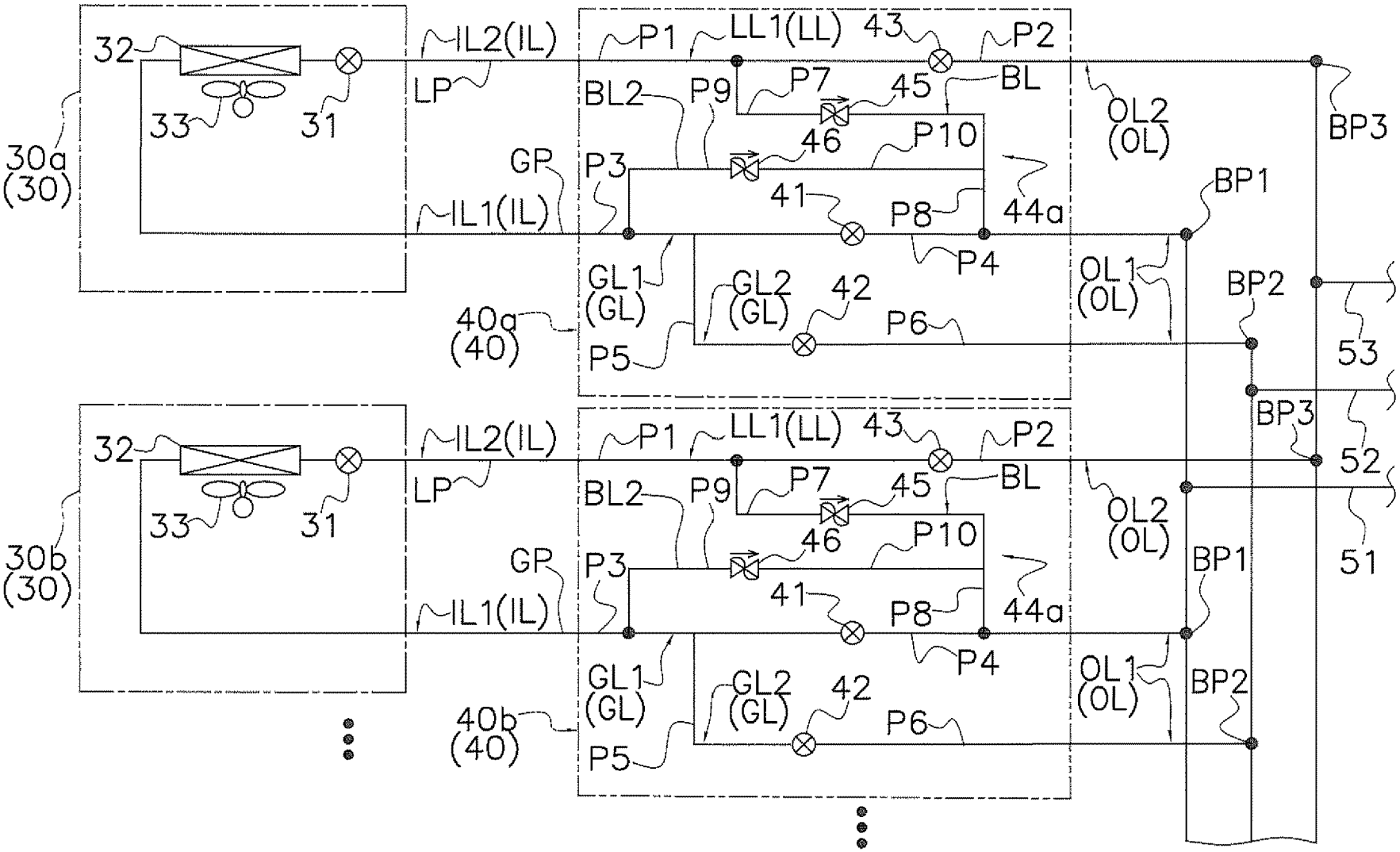
FIG. 8 illustrates a refrigerant circuit of another example according to a seventh modification.

Moreover, in this case, for example, as illustrated in FIG. 8, by disposing a pressure adjusting portion 44*a* instead of the pressure adjusting portion 44, formation of a liquid seal circuit is more reliably reduced. The pressure adjusting portion 44*a* includes bypass pipes (P9, P10) that form a second bypass flow path BL2, in addition to the bypass pipes (P7, P8) that form the bypass flow path BL. The second bypass flow path BL2 extends from the indoor-side gas-refrigerant flow path IL1 to a part of the bypass flow path BL between both ends of the bypass flow path BL (to be more specific, a part of the bypass flow path BL closer than the pressure adjusting valve 45 to the outdoor-side gas-refrigerant flow path OL1).

The pressure adjusting portion 44*a* includes a second pressure adjusting valve 46, in addition to the pressure adjusting valve 45. The second pressure adjusting valve 46 is a "bypass mechanism" similar to the pressure adjusting valve 45. The second pressure adjusting valve 46 is disposed in the second bypass flow path BL2.

By disposing the pressure adjusting portion 44*a* instead of the pressure adjusting portion 44, formation of a liquid seal circuit is more reliably reduced. In this case, the indoor expansion valve 31 may be controlled to be opened when operation is stopped or when refrigerant leakage occurs.

(6-8) Eighth Modification

In the embodiment, the plurality of intermediate units 40, which correspond one-to-one to the indoor units 30, are individually disposed. However, the configuration of the intermediate units 40 is not limited to this.

For example, one or more intermediate units 40 may be structured and disposed so as to correspond one-to-many or many-to-one to the indoor units 30.

Figure 9:
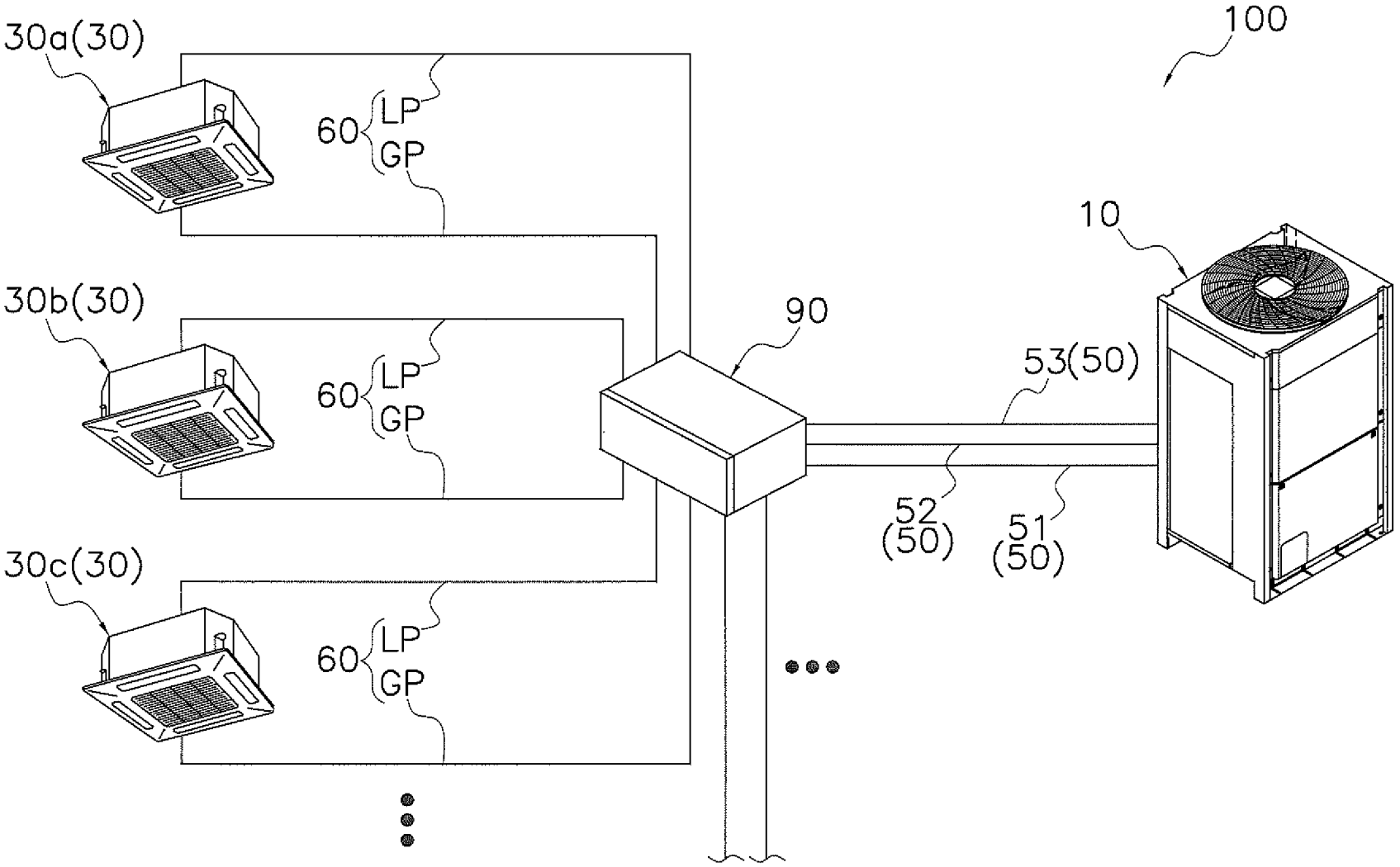
FIG. 9 is an overall view of an air conditioning system according to an eighth modification.
Figure 10:
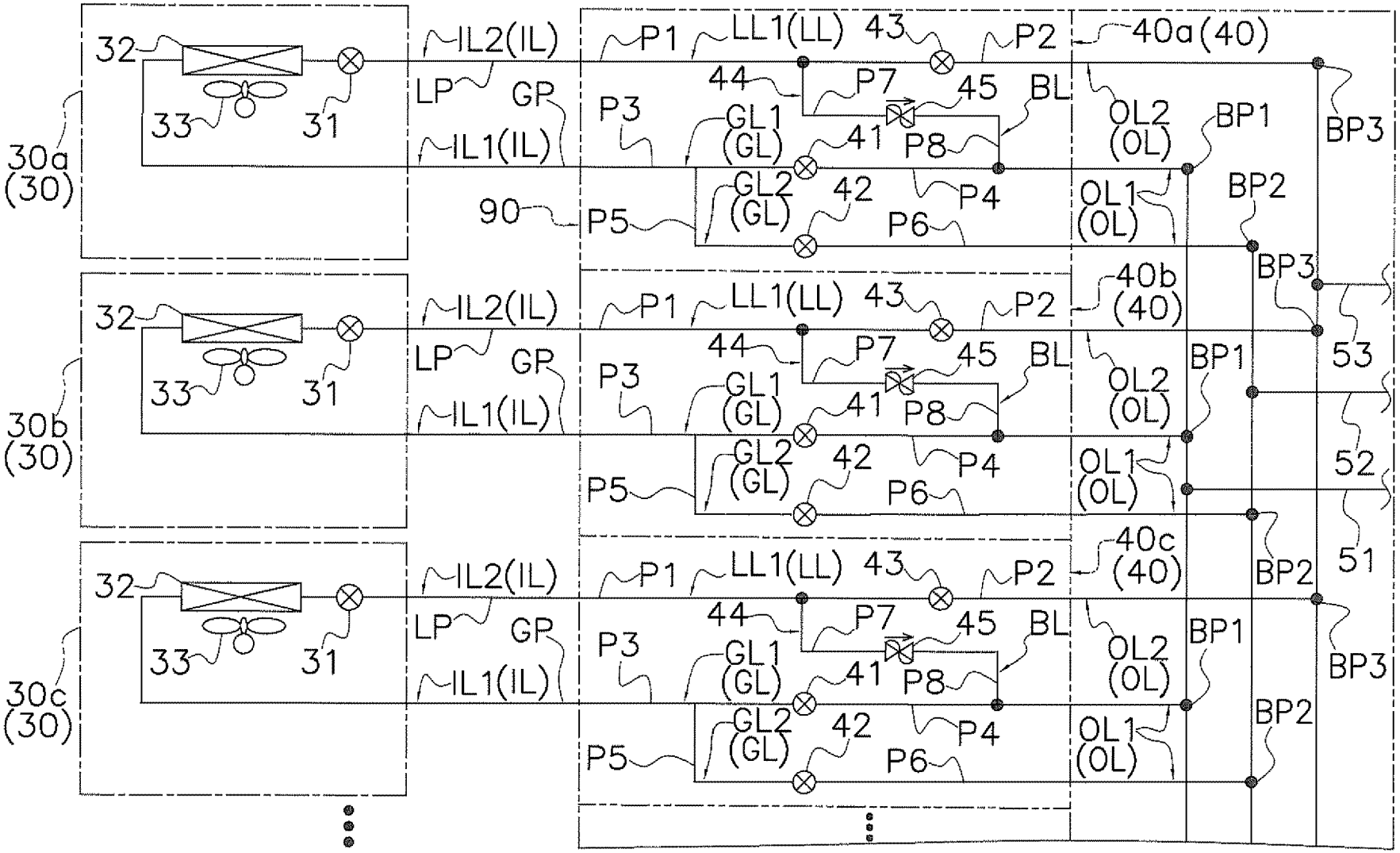
FIG. 10 illustrates a refrigerant circuit in indoor units and intermediate units according to the eighth modification.

Alternatively, for example, as illustrated in FIGS. 9 and 10, a collective flow-path-switching unit 90, in which a plurality of (for example, four, eight, or sixteen) intermediate units 40 are accommodated in a housing, may be disposed between the outdoor unit 10 and the indoor units 30. In the collective flow-path-switching unit 90 (corresponding to "flow path switching unit" in the claims), the plurality of intermediate units 40, the first connection pipe 51, and parts of the second connection pipe 52 and the third connection pipe 53 are accommodated in the casing. In this case, the collective flow-path-switching unit 90 corresponds to an indoor unit group ("utilization unit group") of the plurality of indoor units 30.

Figure 11:
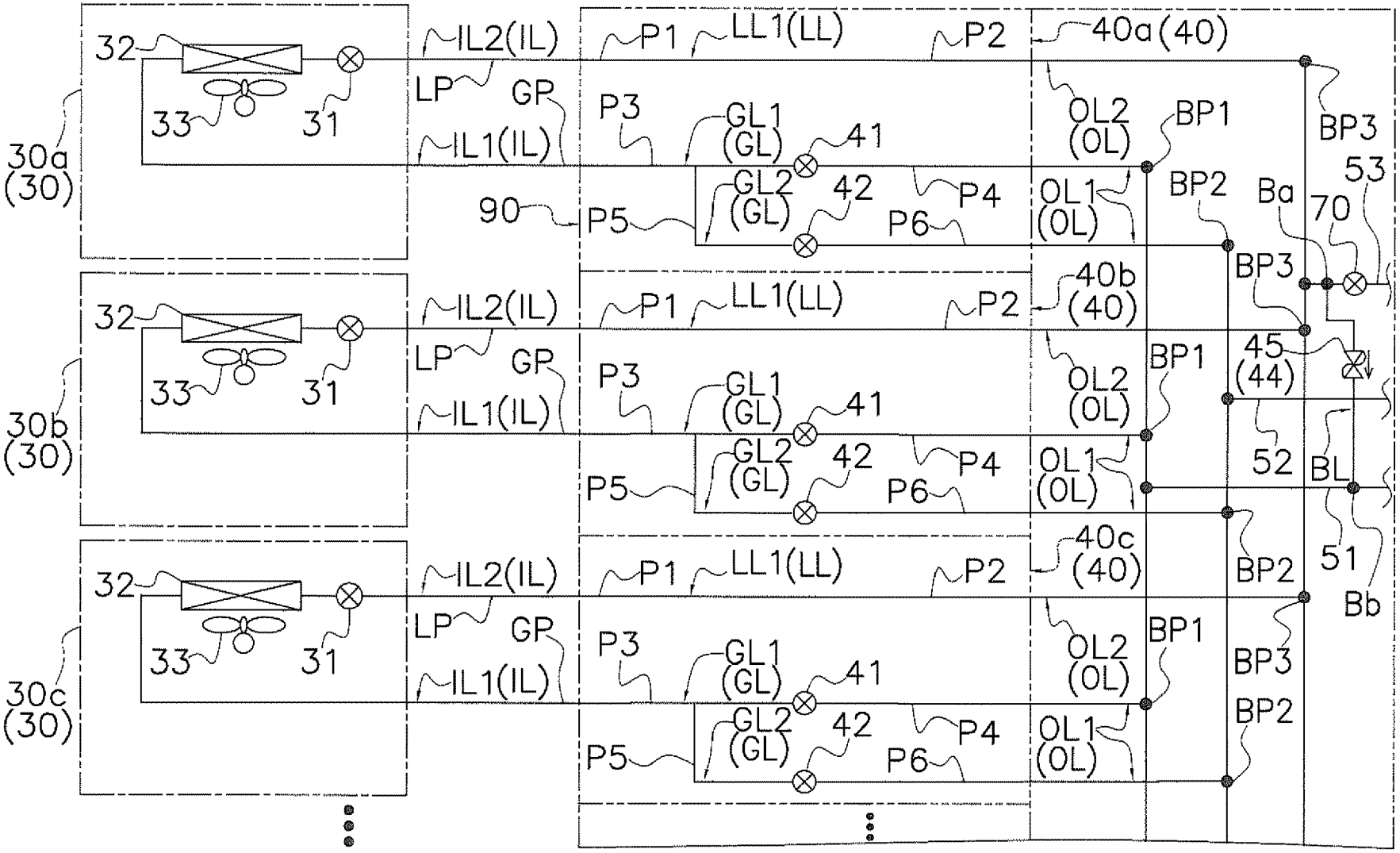
FIG. 11 illustrates a refrigerant circuit in indoor units and intermediate units of another example according to the eighth modification.

In the case where the collective flow-path-switching unit 90 is disposed, if the third control valve 43 is omitted, as illustrated in FIG. 11, in order to suppress flow of refrigerant from the outdoor unit 10 to each of the indoor units 30 when, for example, refrigerant leakage occurs, a shutoff valve 70 (corresponding to "second shutoff valve") common to the liquid-side branch flow paths LL1 may be disposed at a position closer than each of the liquid-side branching portions BP3 to the outdoor unit 10. In relation to this, in order to suppress formation of a liquid seal circuit when the shutoff valve 70 is controlled to be closed, as illustrated in FIG. 11, the bypass flow path BL may extend from a first bypass portion Ba disposed in the third connection pipe 53 to a second bypass portion Bb disposed in the first connection pipe 51. The first bypass portion Ba is disposed at a position that is closer than the liquid-side branching portion BP3 to the outdoor unit 10 and that is closer than the shutoff valve 70 to the indoor unit 30. The second bypass portion Bb is disposed closer than each of the gas-side first branching portions BP1 to the outdoor unit 10. In FIG. 11, the indoor-side liquid-refrigerant flow path IL2 extends between the shutoff valve 70 and each of the indoor heat exchangers 32.

Also when the refrigerant circuit RC is configured as illustrated in FIG. 11, advantageous effects that are the same as those of the embodiment can be realized. Moreover, because the third control valve 43 disposed in each of the intermediate units 40 is omitted, the shutoff valve 70 is disposed common to the liquid-side branch flow paths LL1, and the pressure adjusting portion 44 is not disposed in each of the intermediate units 40 but is disposed common to the intermediate units 40, the circuit can be simply structured and costs can be reduced.

The shutoff valve 70 is an electric valve whose opening degree is adjustable, or is an electromagnetic valve that can be switched between an open state and a closed state.

(6-9) Ninth Modification

Figure 12:
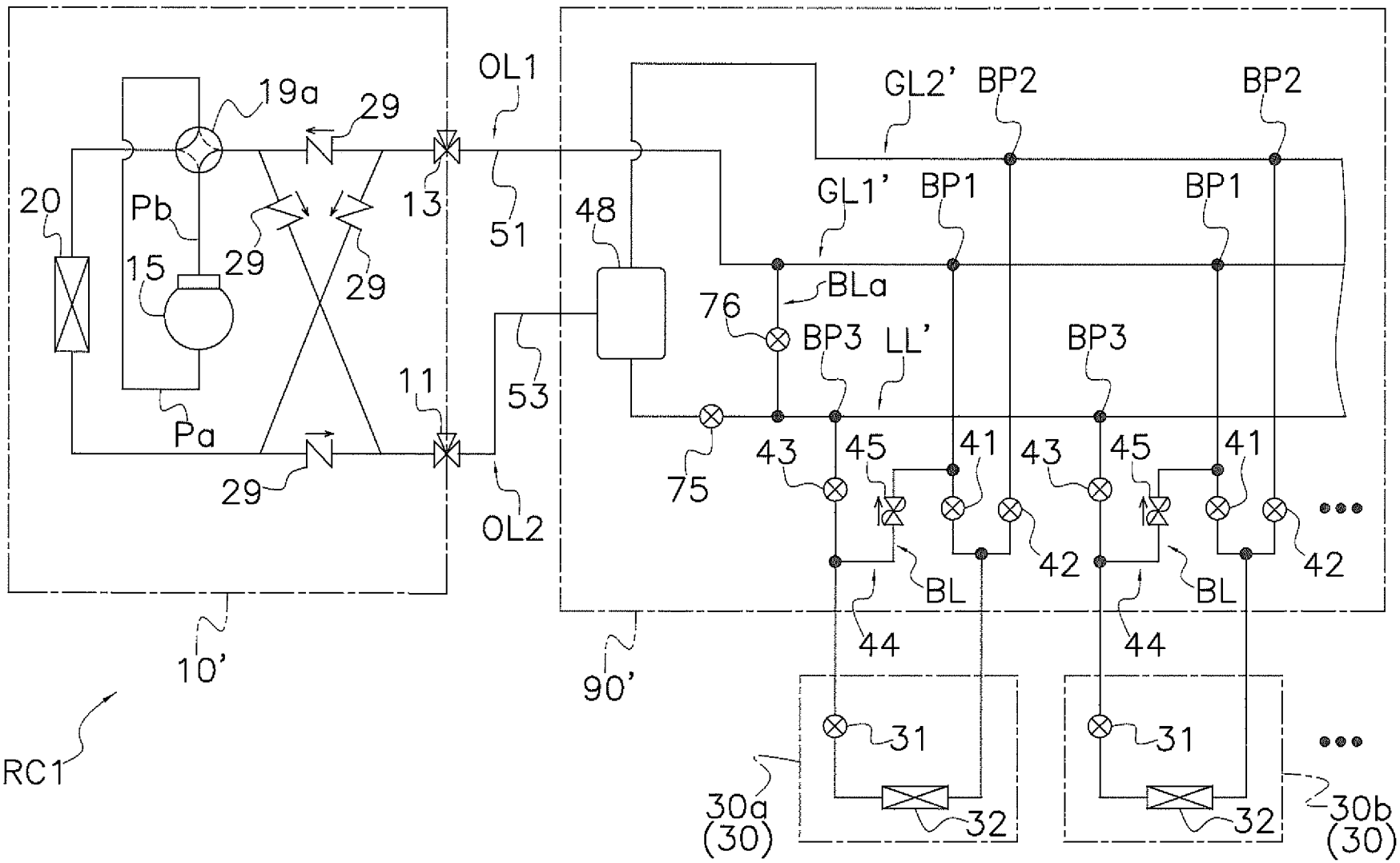
FIG. 12 illustrates a refrigerant circuit according to a ninth modification.

In the embodiment, the refrigerant circuit RC is a so-called "three pipe" cooling/heating free circuit (a refrigerant circuit in which the indoor units 30 can be individually switched between cooling operation and heating operation), in which the outdoor unit 10 and the intermediate units 40 are connected by three connection pipes (51, 52, and 53). However, the outdoor unit 10 and the intermediate units 40 need not be connected by three connection pipes (51, 52, and 53). For example, the refrigerant circuit RC may be structured as a refrigerant circuit RC1 illustrated in FIG. 12.

The refrigerant circuit RC1 is a "two pipe" cooling/heating free circuit, in which the outdoor unit 10 and a collective flow-path-switching unit 90' are connected by two connection pipes. In the refrigerant circuit RC1, an outdoor unit 10' is disposed instead of the outdoor unit 10. In the outdoor unit 10', devices such as the gas-side second shutoff valve 12, the accumulator 14, the flow-path switching valves 19, and the subcooling heat exchanger 27 are omitted. In the outdoor unit 10', a four-way switching valve 19*a* is disposed. In the outdoor unit 10', four check valves 29 are disposed in a bridge pattern. In the refrigerant circuit RC1, a collective flow-path-switching unit 90' is disposed. In the refrigerant circuit RC1, the outdoor unit 10 and the collective flow-path-switching unit 90' are connected by two connection pipes (the first connection pipe 51 and the third connection pipe 53).

In the collective flow-path-switching unit 90', a receiver 48, which stores refrigerant and separates refrigerant into gas refrigerant and liquid refrigerant, is disposed. The receiver 48 is connected to the second connection pipe 52. From the receiver 48, the liquid-side refrigerant flow path LL' and the second gas-side refrigerant flow path GL2' extend. The first gas-side refrigerant flow path GL1' is connected to the first connection pipe 51. In the refrigerant circuit RC1, a control valve 75 is disposed in the liquid-side refrigerant flow path LL' at a position closer than each of the liquid-side branching portions BP3 to the outdoor unit 10. In the refrigerant circuit RC1, a bypass flow path BLa is formed, in addition to each of the bypass flow paths BL. The bypass flow path BLa connects a part of the liquid-side refrigerant flow path LL' closer than each of the liquid-side branching portions BP3 to the outdoor unit 10 and a part of the first gas-side refrigerant flow path GL' closer than each of gas-side first branching portions BP1 to the outdoor unit 10. A control valve 76 is disposed in the bypass flow path BLa.

The refrigerant circuit RC1 is a "two pipe" cooling/heating free circuit. Also in this case, by appropriately disposing the pressure adjusting portion 44 and appropriately opening and closing the control valve 76, formation of a liquid seal circuit is reduced as in the embodiment.

(6-10) Tenth Modification

The refrigerant circuit RC is a so-called "cooling/heating free circuit" that includes the plurality of intermediate units 40, that can individually switch flow of refrigerant in the indoor units 30, and that can individually select between cooling operation and heating operation of the indoor units 30. However, the refrigerant circuit RC need not be a "cooling/heating free circuit". As in a refrigerant circuit RC2 shown in FIG. 13, the refrigerant circuit RC may be a so-called "cooling/heating switching circuit" that collectively switches between cooling operation and heating operation of the indoor units 30 (that is, a refrigerant circuit that cannot individually switch between cooling operation and heating operation of the indoor units 30).

In the refrigerant circuit RC2, an outdoor unit 10*a* is disposed instead of the outdoor unit 10. In the outdoor unit 10*a*, devices such as the gas-side second shutoff valve 12 and each of the flow-path switching valves 19 are omitted. In the outdoor unit 10*a*, a four-way switching valve 19*b* is disposed.

In the refrigerant circuit RC2, indoor units 30' (30*a*', 30*b*', and 30*c*') are disposed instead of the indoor units 30.

In the refrigerant circuit RC2, each of the intermediate units 40 is omitted. In relation to this, the outdoor unit 10*a* and each of the indoor units 30' are connected by two connection pipes (the gas-side connection pipe GP and the liquid-side connection pipe LP). In the refrigerant circuit RC2, the gas-side connection pipe GP forms the outdoor-side gas-refrigerant flow path OL1, and the liquid-side connection pipe LP forms the outdoor-side liquid-refrigerant flow path OL2. In the refrigerant circuit RC2, the indoor expansion valve 31 functions as a "second shutoff valve".

In each of the indoor units 30', an indoor-side control valve 34 is disposed between the gas-side port of the indoor heat exchanger 32 and the gas-side connection pipe GP. The indoor-side control valve 34 is an electric valve whose opening degree is adjustable, or is an electromagnetic valve that can be switched between an open state and a closed state. In the refrigerant circuit RC2, the indoor-side control valve 34 functions as a "first shutoff valve".

In the refrigerant circuit RC2, the indoor-side gas-refrigerant flow path IL1 is formed between the gas-side of the indoor heat exchanger 32 and the indoor-side control valve 34, and the indoor-side liquid-refrigerant flow path IL2 is formed between the liquid-side of the indoor heat exchanger 32 and the indoor expansion valve 31. In the refrigerant circuit RC2, the outdoor-side gas-refrigerant flow path OL1 is formed between the indoor-side control valve 34 and the outdoor unit 10*a*, and the outdoor-side liquid-refrigerant flow path OL2 is formed between the indoor expansion valve 31 and the outdoor unit 10*a*.

In the refrigerant circuit RC2, a pressure adjusting portion 44' is disposed in each of the indoor units 30'. In the pressure adjusting portion 44', the bypass flow path BL extends from the indoor-side gas-refrigerant flow path IL1 to the outdoor-side gas-refrigerant flow path OL1. To be specific, the pressure adjusting portion 44' includes bypass pipes (an eleventh pipe P11 and a twelfth pipe P12) that form the bypass flow path BL. The pressure adjusting valve 45 is disposed in the bypass flow path BL.

Figure 13:
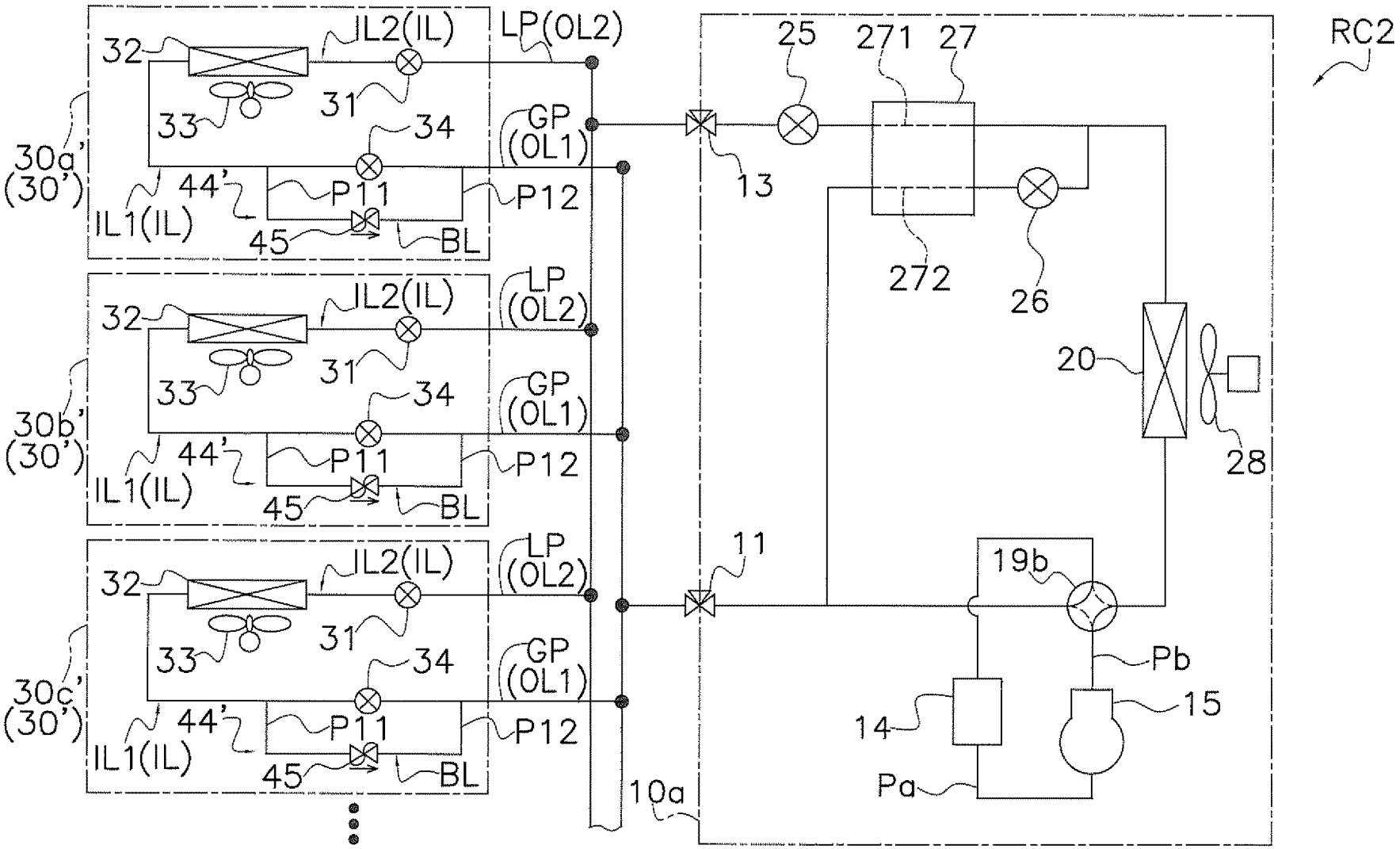
FIG. 13 illustrates a refrigerant circuit according to a tenth modification.

The refrigerant circuit RC2 is a "cooling/heating switching circuit". Also in this case, by disposing the pressure adjusting portion 44' as illustrated in FIG. 13, formation of a liquid seal circuit is reduced as in the embodiment.

In the refrigerant circuit RC2, bypass pipes (P11, P12) may be disposed in such a way that the bypass flow path BL extends from the indoor-side liquid-refrigerant flow path IL2 to the outdoor-side gas-refrigerant flow path OL1 or the outdoor-side liquid-refrigerant flow path OL2.

(6-11) Eleventh Modification

Figure 14:
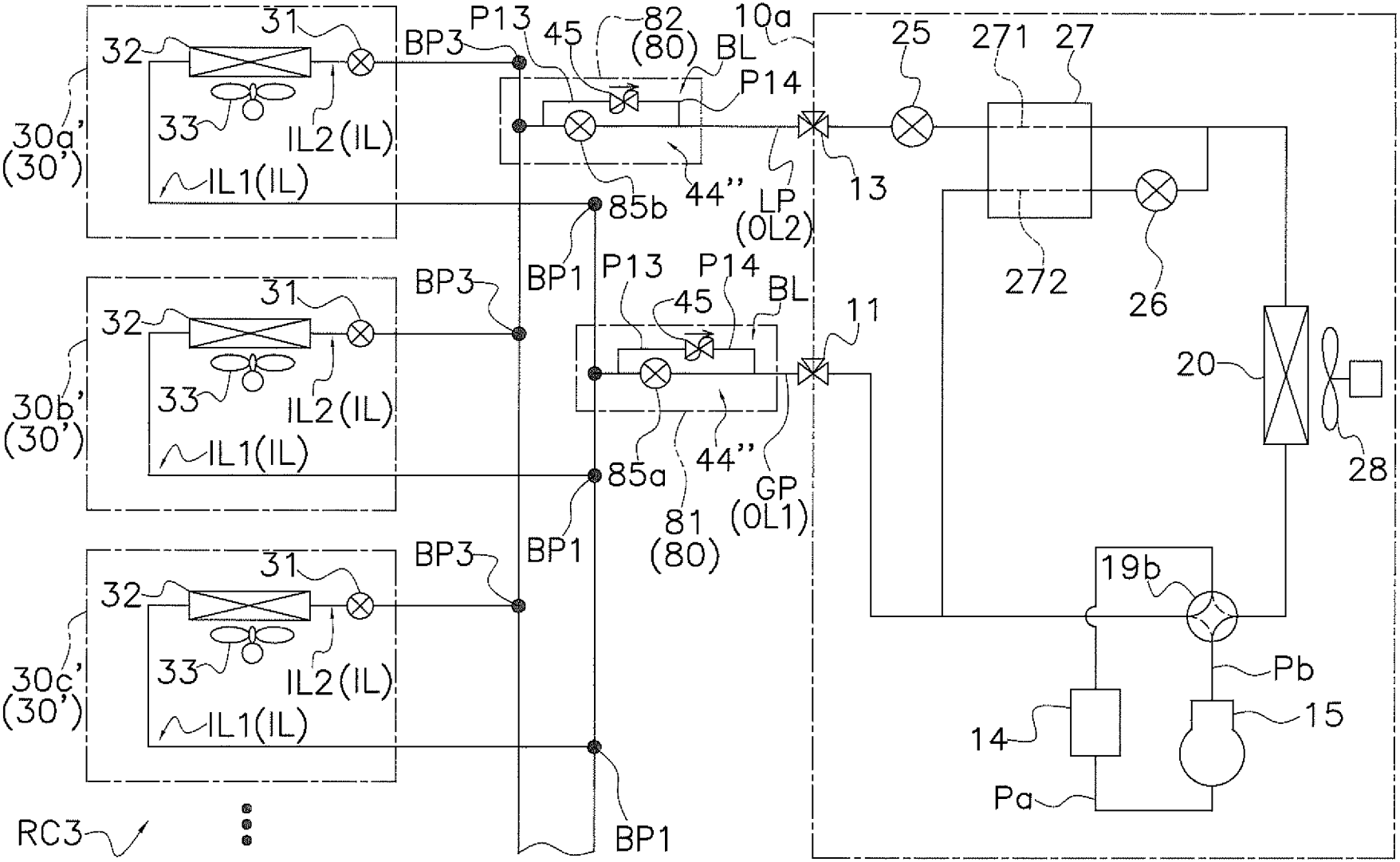
FIG. 14 illustrates a refrigerant circuit according to an eleventh modification.

The refrigerant circuit RC2 may be formed as a refrigerant circuit RC3 illustrated in FIG. 14. In the refrigerant circuit RC3, the indoor-side control valve 34 and the pressure adjusting portion 44' are omitted in the indoor units 30'. On the other hand, in the refrigerant circuit RC3, a plurality of (here, two) shutoff valve units 80 (a first shutoff valve unit 81 and a second shutoff valve unit 82) are disposed between the outdoor unit 10*a* and each of the indoor units 30'.

Each of the shutoff valve units 80 is a unit that corresponds to a plurality of indoor units 30' (indoor unit group) and functions to block flow of refrigerant. The shutoff valve unit 80 is a unit in which a branch pipe and a shutoff valve are integrated. The shutoff valve unit 80 is transported to an installation site in a preassembled state and is joined to other connection pipes, and thereby forms a part of the gas-side connection pipe GP or a part of the liquid-side connection pipe LP. The shutoff valve unit 80 includes a shutoff valve 85 and a pressure adjusting portion 44".

The first shutoff valve unit 81 is disposed in the gas-side connection pipe GP (the outdoor-side gas-refrigerant flow path OL1). The first shutoff valve unit 81 includes a gas-side shutoff valve 85*a* (corresponding to "first shutoff valve") disposed in the outdoor-side gas-refrigerant flow path OL1. The gas-side shutoff valve 85*a* is an electric valve whose opening degree is adjustable, or is an electromagnetic valve that can be switched between an open state and a closed state. The gas-side shutoff valve 85*a* is disposed closer than each of gas-side first branching portions BP1, which is disposed in the gas-side connection pipe GP, to the outdoor unit 10.

The second shutoff valve unit 82 is disposed in the liquid-side connection pipe LP (the outdoor-side liquid-refrigerant flow path OL2). The second shutoff valve unit 82 includes a liquid-side shutoff valve 85*b* (corresponding to "second shutoff valve") disposed in the outdoor-side liquid-refrigerant flow path OL2. The liquid-side shutoff valve 85*b* is an electric valve whose opening degree is adjustable, or is an electromagnetic valve that can be switched between an open state and a closed state. The liquid-side shutoff valve 85*b* is disposed closer than each of the liquid-side branching portions BP3 of the liquid-side connection pipe LP to the outdoor unit 10.

In the refrigerant circuit RC3, the outdoor-side gas-refrigerant flow path OL1 and the outdoor-side liquid-refrigerant flow path OL2 are formed at positons closer than the shutoff valve 85 to the outdoor unit 10. In the refrigerant circuit RC3, the indoor-side gas-refrigerant flow path IL1 and the indoor-side liquid-refrigerant flow path IL2 are formed at positions closer than the shutoff valve 85 to the indoor unit 30.

In the refrigerant circuit RC3, the pressure adjusting portion 44" is disposed in the shutoff valve units 80. In the pressure adjusting portion 44", the bypass flow path BL extends from the indoor-side gas-refrigerant flow path IL1 to the outdoor-side gas-refrigerant flow path OL1. To be specific, the pressure adjusting portion 44" includes bypass pipes (a thirteenth pipe P13 and a fourteenth pipe P14) that form the bypass flow path BL. The pressure adjusting valve 45 is disposed in the bypass flow path BL.

The refrigerant circuit RC3 is a "cooling/heating switching circuit". Also in this case, by disposing the pressure adjusting portion 44" as illustrated in FIG. 14, formation of a liquid seal circuit is reduced when the shutoff valve (85*a*, 85*b*) enters a closed state, as in the embodiment.

The liquid-side shutoff valve 85*b* can be omitted in the refrigerant circuit RC3 by causing the indoor expansion valve 31 to function as a "second shutoff valve". That is, the second shutoff valve unit 82 may be omitted as appropriate.

In the refrigerant circuit RC3, the first shutoff valve unit 81 is disposed common to the gas-side connection pipe GP, which communicates with each of the indoor units 30. However, a plurality of first shutoff valve units 81 may be disposed. For example, the first shutoff valve unit 81 may be disposed for each of the gas-side first branching portions BP1 of the gas-side connection pipe GR That is, the first shutoff valve units 81 may be disposed so as to correspond one-to-one to the indoor units 30. The first shutoff valve unit 81 may be disposed in the indoor-side gas-refrigerant flow path IL1 that communicates with a corresponding one of the indoor units 30.

In the refrigerant circuit RC3, the second shutoff valve unit 82 is disposed common to the liquid-side connection pipe LP, which communicates with each of the indoor units 30. However, a plurality of second shutoff valve units 82 may be disposed. For example, the second shutoff valve unit 82 may be disposed for each of liquid-side branching portions BP3 of the liquid-side connection pipe LP. That is, the second shutoff valve unit 82 may be disposed so as to correspond one-to-one to the indoor units 30. The second shutoff valve unit 82 may be disposed in the indoor-side liquid-refrigerant flow path IL2 that communicates with a corresponding one of the indoor units 30.

In the refrigerant circuit RC3, the pressure adjusting portion 44" is disposed in each of the first shutoff valve unit 81 and the second shutoff valve unit 82. However, the pressure adjusting portion 44" need not be disposed in each of the first shutoff valve unit 81 and the second shutoff valve unit 82. The pressure adjusting portion 44" in one of the first shutoff valve unit 81 and the second shutoff valve unit 82 may be omitted, as appropriate.

(6-12) Twelfth Modification

In the embodiment, the pressure adjusting valve 45 (corresponding to "bypass mechanism") is a mechanical automatic expansion valve that includes a pressure sensing mechanism in which a valve disc moves when a pressure that is higher than or equal to a pressure reference value is applied to one side thereof. However, the pressure adjusting valve 45 may be a different valve as long as the valve can bypass refrigerant in the indoor-side refrigerant flow path IL, having a pressure higher than or equal to a pressure reference value, to the outdoor-side refrigerant flow path OL. For example, the pressure adjusting valve 45 may be an electric expansion valve that is slightly open and forms a very small flow path that allows refrigerant to pass therethrough when the opening degree is the minimum. Also in this case, because refrigerant in the indoor-side refrigerant flow path IL is bypassed to the outdoor-side refrigerant flow path OL via the very small flow path in the pressure adjusting valve 45, advantageous effects described in (5-1) can be realized.

(6-13) Thirteenth Modification

In the embodiment, each of the first control valve 41, the second control valve 42, and the third control valve 43 is an electric valve whose opening degree is adjustable and that blocks flow of refrigerant when the opening degree is the minimum. However, the first control valve 41, the second control valve 42, or the third control valve 43 may be a different valve as long as the valve can switch flow of refrigerant between the outdoor unit 10 and the corresponding indoor unit 30. For example, the first control valve 41, the second control valve 42, or the third control valve 43 may be an electromagnetic valve that is selectively switched between an open state and a fully closed state when a drive voltage is supplied. For example, the first control valve 41, the second control valve 42, or the third control valve 43 may be an electric expansion valve that is slightly open and forms a very small flow path that allows refrigerant to pass therethrough when the opening degree is the minimum. In this case, formation of a liquid seal circuit in the indoor-side refrigerant flow path IL is further reduced.

(6-14) Fourteenth Modification

In the embodiment, the first control valve 41 is disposed in the first gas-side refrigerant flow path GL1 (the second pipe P2 or the third pipe P3) that communicates with the first connection pipe 51. However, the position of the first control valve 41 is not limited to this, and the first control valve 41 may be disposed in the first connection pipe 51.

In the embodiment, the second control valve 42 is disposed in the second gas-side refrigerant flow path GL2 (the fourth pipe P4 or the fifth pipe P5) that communicates with the second connection pipe 52. However, the position of the second control valve 42 is not limited to this, and the second control valve 42 may be disposed in the second connection pipe 52.

In the embodiment, the third control valve 43 is disposed in the liquid-side refrigerant flow path LL (the first pipe P1 or the second pipe P2) that communicates with the third connection pipe 53. However, the position of the third control valve 43 is not limited to this, and the second control valve 42 may be disposed in the third connection pipe 53.

(6-15) Fifteenth Modification

In the embodiment, a plurality of flow-path switching valves 19 (the first flow-path switching valve 16, the second flow-path switching valve 17, and the third flow-path switching valve 18) are disposed in the refrigerant circuit RC, and the flow-path switching valves 19 are switched between a first flow path state and a second flow path state in accordance with the operation state, and thereby flow of refrigerant in the refrigerant circuit RC is switched. However, a method of switching flow of refrigerant is not limited to this, and flow of refrigerant in the refrigerant circuit RC may be switched by using a different method.

For example, instead of any of the flow-path switching valves 19 (four-way switching valves), a three-way valve may be disposed. For example, instead of any of the flow-path switching valves 19, a first valve (for example, an electromagnetic valve or an electric valve) and a second valve (for example, an electromagnetic valve or an electric valve) may be disposed. In this case, a refrigerant flow path that is formed when the flow-path switching valve 19 is in a first flow path state in the embodiment may be opened by controlling the first valve to be in an open state and controlling the second valve to be in a fully closed state; and, a refrigerant flow path that is formed when the flow-path switching valve 19 is in a second flow path state in the embodiment may be opened by controlling the first valve to be in a fully closed state and controlling the second valve to be in an open state.

(6-16) Sixteenth Modification

The circuit structure of the refrigerant circuit RC in the embodiment or devices disposed in the refrigerant circuit RC may be changed in accordance with the setting environment and design specifications, as long as the object of the idea according to the present disclosure can be achieved without causing a problem. Some of the devices may be omitted, the refrigerant circuit RC may include other devices, and the refrigerant circuit RC may include other flow paths.

For example, the subcooling heat exchanger 27 disposed in the outdoor unit 10 is not necessary and may be omitted. In the refrigerant circuit RC, a receiver for storing refrigerant may be disposed at an appropriate position (for example, in the liquid-side pipe Pc) if necessary. The refrigerant circuit RC may include a flow path that is not illustrated in FIGS. 1 and 2 (for example, a flow path for injecting intermediate-pressure refrigerant into the compressor 15).

For example, the indoor expansion valve 31 need not be disposed in the indoor unit 30. The indoor expansion valve 31 is not necessary. The indoor expansion valve 31 may be omitted by causing the third control valve 43 of a corresponding one of the intermediate units 40 to function as the indoor expansion valve 31.

(6-17) Seventeenth Modification

In the embodiment, the number of the outdoor unit 10 is only one. However, a plurality of outdoor units 10 may be disposed in series or in parallel with the indoor units 30 or the intermediate units 40.

(6-18) Eighteenth Modification

In the embodiment, the idea according to the present disclosure is applied to the air conditioning system 100. However, the application of the idea is not limited to this. The idea according to the present disclosure is also applicable to another refrigeration apparatus (such as a water heater or a chiller) that includes a refrigerant circuit similar to the refrigerant circuit RC of the embodiment.

(6-19) Nineteenth Modification

In the embodiment, R32 is used as an example of refrigerant that circulates through the refrigerant circuit RC. However, refrigerant used in the refrigerant circuit RC is not limited. For example, in the refrigerant circuit RC, HFO1234yf, HFO1234ze(E), a mixture of these, or the like may be used instead of R32. In the refrigerant circuit RC, HFC refrigerant, such as R407C or R410A, may be used.

(7)

Heretofore, an embodiment of the present invention has been described. It should be understood that forms and details can be changed in various ways within the spirit and scope of the present invention described in the claims.

INDUSTRIAL APPLICABILITY

The present disclosure can be used for a refrigeration apparatus.

REFERENCE SIGNS LIST

10, 10', 10*a* outdoor unit (heat source unit)
11 gas-side first shutoff valve
12 gas-side second shutoff valve
13 liquid-side shutoff valve
14 accumulator
15 compressor
16 first flow-path switching valve
17 second flow-path switching valve
18 third flow-path switching valve
19*a*, 19*b* four-way switching valve
20 outdoor heat exchanger (heat-source-side heat exchanger)
21 first outdoor heat exchanger
22 second outdoor heat exchanger
23 first outdoor control valve
24 second outdoor control valve
25 third outdoor control valve
26 fourth outdoor control valve
27 subcooling heat exchanger
28 outdoor fan
30, 30' indoor unit (utilization units)
31 indoor expansion valve (electric expansion valve, second shutoff valve)
32 indoor heat exchanger (utilization-side heat exchanger)
33 indoor fan
34 indoor-side control valve (first shutoff valve)
40, 400, 500, 600 intermediate unit (refrigerant-flow-path switching unit)
41 first control valve (first shutoff valve)
42 second control valve (first shutoff valve)
43 third control valve (second shutoff valve)
44, 44', 44", 44*a* pressure adjusting portion
45 pressure adjusting valve (bypass mechanism)
46 second pressure adjusting valve (bypass mechanism)
48 receiver
50 outdoor-side connection pipe
51 first connection pipe
52 second connection pipe
53 third connection pipe
60 indoor-side connection pipe
70 shutoff valve (second shutoff valve)
75, 76 control valve
80 shutoff valve unit
81 first shutoff valve unit
82 second shutoff valve unit
85 shutoff valve
85*a* gas-side shutoff valve (first shutoff valve)
85*b* liquid-side shutoff valve (second shutoff valve)
90, 90' collective flow-path-switching unit (refrigerant-flow-path switching unit)
100 air conditioning system (refrigeration apparatus)
271 first flow path
272 second flow path
BL, BL', BLa bypass flow path
BL2 second bypass flow path
BP1 gas-side first branching portion
BP2 gas-side second branching portion
BP3 liquid-side branching portion
GL gas-side refrigerant flow path
GL1, GL1' first gas-side refrigerant flow path (gas-side branch flow paths, gas-side first branch flow paths)
GL2, GL2' second gas-side refrigerant flow path (gas-side branch flow paths, gas-side second branch flow paths)
GP gas-side connection pipe
IL indoor-side refrigerant flow path (utilization-side refrigerant flow path)
IL1 indoor-side gas-refrigerant flow path
IL2 indoor-side liquid-refrigerant flow path
LL liquid-side refrigerant flow path
LL1 liquid-side branch flow paths
LP liquid-side connection pipe
OL outdoor-side refrigerant flow path (heat-source-side refrigerant flow path)
OL1 outdoor-side gas-refrigerant flow path
OL2 outdoor-side liquid-refrigerant flow path
P1 to P6 first to sixth pipes
P7, P7' seventh pipe (bypass pipe)
P8, P8' eighth pipe (bypass pipe)
P11 eleventh pipe (bypass pipe)
P12 twelfth pipe (bypass pipe)
P13 thirteenth pipe (bypass pipe)
P14 fourteenth pipe (bypass pipe)
Pa suction pipe
Pb discharge pipe
Pc liquid-side pipe
RC, RC1, RC2, RC3 refrigerant circuit

CITATION LIST

Patent Literature

PTL 1: Japanese Patent No. 5517789

The invention claimed is:

1. A refrigeration apparatus that performs a refrigeration cycle in a refrigerant circuit, the refrigeration apparatus comprising:

a heat-source-side heat exchanger;

a utilization-side heat exchanger;

a first shutoff valve that is disposed in a gas-side refrigerant flow path disposed between the heat-source-side heat exchanger and the utilization-side heat exchanger and that blocks flow of refrigerant when fully closed;

a second shutoff valve that is disposed in a liquid-side refrigerant flow path disposed between the heat-source-side heat exchanger and the utilization-side heat exchanger and that blocks flow of refrigerant when fully closed; and a pressure adjusting portion that adjusts a pressure of refrigerant in a utilization-side refrigerant flow path disposed between the first shutoff valve or the second shutoff valve and the utilization-side heat exchanger, wherein the pressure adjusting portion includes a bypass mechanism that bypasses the refrigerant in the utilization-side refrigerant flow path to a heat-source-side refrigerant flow path disposed between the first shutoff valve or the second shutoff valve and the heat-source-side heat exchanger, wherein the pressure adjusting portion further includes a bypass pipe that forms a bypass flow path extending from the utilization-side refrigerant flow path to the heat-source-side refrigerant flow path, and the bypass mechanism is a pressure adjusting valve that is disposed in the bypass flow path and that opens the bypass flow path when the first shutoff valve and the second shutoff valve are fully closed, and the pressure of the refrigerant in the utilization-side refrigerant flow path becomes higher than or equal to a predetermined reference value.

2. The refrigeration apparatus according to claim 1, wherein the pressure adjusting valve is a valve that allows refrigerant to pass therethrough when receiving a pressure higher than or equal to the reference value.

3. The refrigeration apparatus according to claim 2, wherein the bypass flow path extends from the utilization-side refrigerant flow path to a heat-source-side first refrigerant flow path disposed between the first shutoff valve and the heat-source-side heat exchanger.

4. The refrigeration apparatus according to claim 2, wherein the bypass flow path extends to a heat-source-side second refrigerant flow path disposed between the second shutoff valve and the heat-source-side heat exchanger.

5. The refrigeration apparatus according to claim 2, further comprising:

an electric expansion valve that is disposed in a refrigerant flow path between the utilization-side heat exchanger and the second shutoff valve and that decompresses refrigerant that passes therethrough in accordance with an opening degree thereof, wherein the electric expansion valve allows the refrigerant to pass therethrough even when the first shutoff valve and the second shutoff valve are fully closed.

6. The refrigeration apparatus according to claim 1, wherein the bypass flow path extends from the utilization-side refrigerant flow path to a heat-source-side first refrigerant flow path disposed between the first shutoff valve and the heat-source-side heat exchanger.

7. The refrigeration apparatus according to claim 6, wherein the bypass flow path extends to a heat-source-side second refrigerant flow path disposed between the second shutoff valve and the heat-source-side heat exchanger.

8. The refrigeration apparatus according to claim 6, further comprising:

an electric expansion valve that is disposed in a refrigerant flow path between the utilization-side heat exchanger and the second shutoff valve and that decompresses refrigerant that passes therethrough in accordance with an opening degree thereof, wherein the electric expansion valve allows the refrigerant to pass therethrough even when the first shutoff valve and the second shutoff valve are fully closed.

9. The refrigeration apparatus according to claim 1, wherein the bypass flow path extends to a heat-source-side second refrigerant flow path disposed between the second shutoff valve and the heat-source-side heat exchanger.

10. The refrigeration apparatus according to claim 9, further comprising:

an electric expansion valve that is disposed in a refrigerant flow path between the utilization-side heat exchanger and the second shutoff valve and that decompresses refrigerant that passes therethrough in accordance with an opening degree thereof, wherein the electric expansion valve allows the refrigerant to pass therethrough even when the first shutoff valve and the second shutoff valve are fully closed.

11. The refrigeration apparatus according to claim 1, further comprising:

an electric expansion valve that is disposed in a refrigerant flow path between the utilization-side heat exchanger and the second shutoff valve and that decompresses refrigerant that passes therethrough in accordance with an opening degree thereof, wherein the electric expansion valve allows the refrigerant to pass therethrough even when the first shutoff valve and the second shutoff valve are fully closed.

12. The refrigeration apparatus according to claim 1, further comprising:

a compressor that is disposed in a refrigerant flow path between the heat-source-side heat exchanger and the first shutoff valve and that compresses refrigerant; and an accumulator that is disposed on a suction side of the compressor and that stores refrigerant.

13. The refrigeration apparatus according to claim 1, further comprising:

a heat source unit in which the heat-source-side heat exchanger is disposed;

a plurality of utilization units in each of which the utilization-side heat exchanger is disposed; and a first shutoff valve unit that is disposed in the gas-side refrigerant flow path disposed between the utilization units and the heat source unit and that blocks flow of refrigerant in corresponding one or more of the utilization units, wherein the first shutoff valve and the pressure adjusting portion are disposed in the first shutoff valve unit.

14. The refrigeration apparatus according to claim 1, further comprising:

a heat source unit in which the heat-source-side heat exchanger is disposed;

a plurality of utilization units in each of which the utilization-side heat exchanger is disposed;

a first shutoff valve unit that is disposed in the gas-side refrigerant flow path disposed between the utilization units and the heat source unit and that blocks flow of refrigerant in corresponding one or more of the utilization units; and a second shutoff valve unit that is disposed in the liquid-side refrigerant flow path disposed between the utilization units and the heat source unit and that blocks flow of refrigerant in corresponding one or more of the utilization units, wherein the first shutoff valve is disposed in the first shutoff valve unit, the second shutoff valve is disposed in the second shutoff valve unit, and the pressure adjusting portion is disposed in the first shutoff valve unit or the second shutoff valve unit, or the pressure adjusting portion is disposed in each of the first shutoff valve unit and the second shutoff valve unit.

15. The refrigeration apparatus according to claim 1, further comprising:

a heat source unit in which the heat-source-side heat exchanger is disposed;

a plurality of utilization units in each of which the utilization-side heat exchanger is disposed and that are arranged in parallel with the heat source unit; and a refrigerant-flow-path switch that is disposed in the gas-side refrigerant flow path and the liquid-side refrigerant flow path disposed between a corresponding one of the utilization units and the heat source unit and that switches flow of refrigerant in the corresponding one of the utilization units, wherein the first shutoff valve, the second shutoff valve, and the pressure adjusting portion are disposed in the refrigerant-flow-path switching unit.

16. The refrigeration apparatus according to claim 15, wherein the gas-side refrigerant flow path includes a plurality of gas-side branch flow paths each of which branches off and is disposed between the heat source unit and a corresponding one of the utilization units, the gas-side branch flow path includes a first gas-side branch flow path in which low-pressure gas refrigerant flows and a second gas-side branch flow path that branches off from the first gas-side branch flow path, that extends to the heat source unit, and in which low-pressure/high-pressure gas refrigerant flows, and the first shutoff valve is disposed in each of the first gas-side branch flow path and the second gas-side branch flow path of each of the gas-side branch flow paths.

17. The refrigeration apparatus according to claim 15, wherein the liquid-side refrigerant flow path includes a plurality of liquid-side branch flow paths each of which branches off and is disposed between the heat source unit and a corresponding one of the utilization units, the liquid-side refrigerant flow path includes a plurality of liquid-side branching portions that are starting points of the liquid-side branch flow paths, the refrigerant-flow-path switching unit corresponds to a utilization unit group constituted by a plurality of the utilization units, the second shutoff valve is disposed closer than each of the liquid-side branching portions to the heat-source-side heat exchanger, and the bypass mechanism bypasses refrigerant in the utilization-side refrigerant flow path disposed between the second shutoff valve and each of the utilization-side heat exchangers to the heat-source-side refrigerant flow path disposed between the first shutoff valve or the second shutoff valve and the heat-source-side heat exchanger.

18. The refrigeration apparatus according to claim 1, further comprising:

an electric expansion valve that is disposed in a refrigerant flow path between the utilization-side heat exchanger and the second shutoff valve and that decompresses refrigerant that passes therethrough in accordance with an opening degree thereof, wherein the electric expansion valve allows the refrigerant to pass therethrough even when the first shutoff valve and the second shutoff valve are fully closed.

19. The refrigeration apparatus according to claim 1, further comprising:

a compressor that is disposed in a refrigerant flow path between the heat-source-side heat exchanger and the first shutoff valve and that compresses refrigerant; and an accumulator that is disposed on a suction side of the compressor and that stores refrigerant.

* * * * *